US009132662B1

(12) United States Patent
Minami

(10) Patent No.: US 9,132,662 B1
(45) Date of Patent: Sep. 15, 2015

(54) PRINTING DEVICE

(71) Applicant: Brother Kogyo Kabushiki Kaisha, Nagoya-shi, Aichi-ken (JP)

(72) Inventor: Akira Minami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/587,125

(22) Filed: Dec. 31, 2014

(30) Foreign Application Priority Data

Mar. 31, 2014 (JP) ..... 2014-074309
Apr. 14, 2014 (JP) ..... 2014-082886

(51) Int. Cl.
*B41J 2/355* (2006.01)
*B41J 2/335* (2006.01)

(52) U.S. Cl.
CPC *B41J 2/335* (2013.01); *B41J 2/355* (2013.01); *B41J 2/3551* (2013.01); *B41J 2/3556* (2013.01)

(58) Field of Classification Search
USPC ..... 347/211, 180, 181, 182, 186
See application file for complete search history.

(56) References Cited

U.S. PATENT DOCUMENTS 5,412,406 A * 5/1995 Fujimoto ..... 347/180
7,582,849 B2 9/2009 Watanabe et al.
8,384,750 B2 * 2/2013 Matsutani ..... 347/211
8,654,160 B2 * 2/2014 Kano ..... 347/188
8,670,010 B2 3/2014 Kano
8,803,932 B2 * 8/2014 Matsutani ..... 347/211
2007/0045280 A1 3/2007 Watanabe et al.
2011/0242256 A1 * 10/2011 Matsutani ..... 347/211
2012/0092433 A1 4/2012 Ogura et al.
2013/0194371 A1 8/2013 Kano

FOREIGN PATENT DOCUMENTS

JP S61-264959 A 11/1986
JP S63-224964 A 9/1988
JP H05-016415 A 1/1993
JP 2007-062282 A 3/2007
JP 2011-025641 A 2/2011
JP 2012-081698 A 4/2012
JP 2012-232600 A 11/2012
JP 2013-022925 A 2/2013
WO 2012-132987 A1 10/2012

* cited by examiner

*Primary Examiner* — Huan Tran
(74) *Attorney, Agent, or Firm* — Banner & Witcoff, Ltd.

(57) ABSTRACT

Every print line lined up to the number of "preset line number 1", the dot number that the main pulse MP is added is counted, and when the variable number M which is the most count number is larger than the variable number A, the value of variable number M/variable number A is set to the variable number of "divisional number" and "9" is set to the variable number of "target speed". When the variable number M corresponding to the most count number is not larger than the variable number A, the dot number that the supplemental pulse HP is added is counted every print line lined up to the number of "preset line number 1" and when the variable number S corresponding to the most count number is larger than the variable number A, "0" is set to the variable number of "divisional number" and "24" is set to the variable number of "target speed".

4 Claims, 21 Drawing Sheets

FIG. 5

PRESET LINE NUMBER TABLE

| NAME | NUMBER |
|---|---|
| PRESET LINE NUMBER 1 | 20 |
| PRESET LINE NUMBER 2 | 10 |

FIG. 6

DOT NUMBER TABLE

| NAME | NUMBER |
|---|---|
| MAXIMUM ON-DOT NUMBER | 180 |
| TOTAL DOT NUMBER OF HEAD | 360 |

FIG. 7

TABLE FOR SPEED AND PRINTING

| NUMBER | SPEED mm/s | PRINT PULSE | DIVISIONAL PRINTING |
|---|---|---|---|
| 0 | 0 | MAIN PULSE + SUPPLEMENTAL PULSE | ○ |
| 1 | 2 | MAIN PULSE + SUPPLEMENTAL PULSE | ○ |
| 2 | 4 | MAIN PULSE + SUPPLEMENTAL PULSE | ○ |
| 3 | 6 | MAIN PULSE + SUPPLEMENTAL PULSE | ○ |
| 4 | 9 | MAIN PULSE + SUPPLEMENTAL PULSE | ○ |
| 5 | 11 | MAIN PULSE + SUPPLEMENTAL PULSE | ○ |
| 6 | 14 | MAIN PULSE + SUPPLEMENTAL PULSE | ○ |
| 7 | 17 | MAIN PULSE + SUPPLEMENTAL PULSE | ○ |
| 8 | 27 | MAIN PULSE + SUPPLEMENTAL PULSE | ○ |
| 9 | 30 | MAIN PULSE + SUPPLEMENTAL PULSE | ○ |
| 10 | 34 | MAIN PULSE + SUPPLEMENTAL PULSE | - |
| 11 | 43 | MAIN PULSE + SUPPLEMENTAL PULSE | - |
| 12 | 50 | MAIN PULSE + SUPPLEMENTAL PULSE | - |
| 13 | 56 | MAIN PULSE + SUPPLEMENTAL PULSE | - |
| 14 | 62 | MAIN PULSE + SUPPLEMENTAL PULSE | - |
| 15 | 66 | MAIN PULSE + SUPPLEMENTAL PULSE | - |
| 16 | 72 | MAIN PULSE + SUPPLEMENTAL PULSE | - |
| 17 | 76 | MAIN PULSE + SUPPLEMENTAL PULSE | - |
| 18 | 81 | MAIN PULSE + SUPPLEMENTAL PULSE | - |
| 19 | 87 | MAIN PULSE + SUPPLEMENTAL PULSE | - |
| 20 | 93 | MAIN PULSE + SUPPLEMENTAL PULSE | - |
| 21 | 98 | MAIN PULSE + SUPPLEMENTAL PULSE | - |
| 22 | 102 | MAIN PULSE + SUPPLEMENTAL PULSE | - |
| 23 | 106 | MAIN PULSE + SUPPLEMENTAL PULSE | - |
| 24 | 110 | MAIN PULSE + SUPPLEMENTAL PULSE | - |
| 25 | 114 | MAIN PULSE + SUB-PULSE (SUPPLEMENTAL PULSE + PREHEAT PULSE) | - |

FIG. 8

ACCELERATION-DECELERATION TABLE

| PRINT SPEED | | PRESENT SPEED | | | | | | | | | | | | | | | | | | | | | | | | | |
|---|---|---|---|---|---|---|---|---|---|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| TARGET SPEED | 0 | 0 | 0 | 0 | 0 | 0 | 0 | 0 | 0 | 0 | 0 | 0 | 6 | 8 | 10 | 11 | 12 | 14 | 15 | 16 | 17 | 18 | 19 | 20 | 21 | 22 | 23 |
| | 1 | 1 | 1 | 1 | 1 | 1 | 1 | 1 | 1 | 1 | 1 | 1 | 6 | 8 | 10 | 11 | 12 | 14 | 15 | 16 | 17 | 18 | 19 | 20 | 21 | 22 | 23 |
| | 2 | 2 | 2 | 2 | 2 | 2 | 2 | 2 | 2 | 2 | 2 | 2 | 6 | 8 | 10 | 11 | 12 | 14 | 15 | 16 | 17 | 18 | 19 | 20 | 21 | 22 | 23 |
| | 3 | 3 | 3 | 3 | 3 | 3 | 3 | 3 | 3 | 3 | 3 | 3 | 6 | 8 | 10 | 11 | 12 | 14 | 15 | 16 | 17 | 18 | 19 | 20 | 21 | 22 | 23 |
| | 4 | 4 | 4 | 4 | 4 | 4 | 4 | 4 | 4 | 4 | 4 | 4 | 6 | 8 | 10 | 11 | 12 | 14 | 15 | 16 | 17 | 18 | 19 | 20 | 21 | 22 | 23 |
| | 5 | 5 | 5 | 5 | 5 | 5 | 5 | 5 | 5 | 5 | 5 | 5 | 6 | 8 | 10 | 11 | 12 | 14 | 15 | 16 | 17 | 18 | 19 | 20 | 21 | 22 | 23 |
| | 6 | 6 | 6 | 6 | 6 | 6 | 6 | 6 | 6 | 6 | 6 | 6 | 6 | 8 | 10 | 11 | 12 | 14 | 15 | 16 | 17 | 18 | 19 | 20 | 21 | 22 | 23 |
| | 7 | 7 | 7 | 7 | 7 | 7 | 7 | 7 | 7 | 7 | 7 | 7 | 7 | 8 | 10 | 11 | 12 | 14 | 15 | 16 | 17 | 18 | 19 | 20 | 21 | 22 | 23 |
| | 8 | 8 | 8 | 8 | 8 | 8 | 8 | 8 | 8 | 8 | 8 | 8 | 8 | 8 | 10 | 11 | 12 | 14 | 15 | 16 | 17 | 18 | 19 | 20 | 21 | 22 | 23 |
| | 9 | 9 | 9 | 9 | 9 | 9 | 9 | 9 | 9 | 9 | 9 | 9 | 9 | 9 | 10 | 11 | 12 | 14 | 15 | 16 | 17 | 18 | 19 | 20 | 21 | 22 | 23 |
| | 10 | 10 | 10 | 10 | 10 | 10 | 10 | 10 | 10 | 10 | 10 | 10 | 10 | 10 | 10 | 11 | 12 | 14 | 15 | 16 | 17 | 18 | 19 | 20 | 21 | 22 | 23 |
| | 11 | 10 | 10 | 10 | 10 | 10 | 10 | 10 | 10 | 10 | 11 | 11 | 11 | 11 | 11 | 11 | 12 | 14 | 15 | 16 | 17 | 18 | 19 | 20 | 21 | 22 | 23 |
| | 12 | 10 | 10 | 10 | 10 | 10 | 10 | 10 | 10 | 10 | 12 | 12 | 12 | 12 | 12 | 12 | 12 | 14 | 15 | 16 | 17 | 18 | 19 | 20 | 21 | 22 | 23 |
| | 13 | 10 | 10 | 10 | 10 | 10 | 10 | 10 | 10 | 10 | 12 | 13 | 13 | 13 | 13 | 13 | 13 | 14 | 15 | 16 | 17 | 18 | 19 | 20 | 21 | 22 | 23 |
| | 14 | 10 | 10 | 10 | 10 | 10 | 10 | 10 | 10 | 10 | 12 | 13 | 14 | 14 | 14 | 14 | 14 | 14 | 15 | 16 | 17 | 18 | 19 | 20 | 21 | 22 | 23 |
| | 15 | 10 | 10 | 10 | 10 | 10 | 10 | 10 | 10 | 10 | 12 | 13 | 14 | 15 | 15 | 15 | 15 | 15 | 15 | 16 | 17 | 18 | 19 | 20 | 21 | 22 | 23 |
| | 16 | 10 | 10 | 10 | 10 | 10 | 10 | 10 | 10 | 10 | 12 | 13 | 14 | 15 | 16 | 16 | 16 | 16 | 16 | 16 | 17 | 18 | 19 | 20 | 21 | 22 | 23 |
| | 17 | 10 | 10 | 10 | 10 | 10 | 10 | 10 | 10 | 10 | 12 | 13 | 14 | 15 | 16 | 16 | 17 | 17 | 17 | 17 | 17 | 18 | 19 | 20 | 21 | 22 | 23 |
| | 18 | 10 | 10 | 10 | 10 | 10 | 10 | 10 | 10 | 10 | 12 | 13 | 14 | 15 | 16 | 16 | 17 | 18 | 18 | 18 | 18 | 18 | 19 | 20 | 21 | 22 | 23 |
| | 19 | 10 | 10 | 10 | 10 | 10 | 10 | 10 | 10 | 10 | 12 | 13 | 14 | 15 | 16 | 16 | 17 | 18 | 18 | 19 | 19 | 19 | 19 | 20 | 21 | 22 | 23 |
| | 20 | 10 | 10 | 10 | 10 | 10 | 10 | 10 | 10 | 10 | 12 | 13 | 14 | 15 | 16 | 16 | 17 | 18 | 18 | 19 | 20 | 20 | 20 | 20 | 21 | 22 | 23 |
| | 21 | 10 | 10 | 10 | 10 | 10 | 10 | 10 | 10 | 10 | 12 | 13 | 14 | 15 | 16 | 16 | 17 | 18 | 18 | 19 | 20 | 21 | 21 | 21 | 21 | 22 | 23 |
| | 22 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 22 | 22 | 22 | 23 |
| | 23 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 23 | 23 | 23 |
| | 24 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 24 | 24 | 24 |
| | 25 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 24 | 25 | 25 |

SUPPLEMENTAL PULSE HP

PREHEAT PULSE YP

FIG. 21

TABLE FOR SPEED AND PRINTING

| NUMBER | SPEED mm/s | PRINT PULSE | DIVISIONAL PRINTING |
|---|---|---|---|
| 0 | 0 | MAIN PULSE + SUPPLEMENTAL PULSE | ○ |
| 1 | 2 | MAIN PULSE + SUPPLEMENTAL PULSE | ○ |
| 2 | 4 | MAIN PULSE + SUPPLEMENTAL PULSE | ○ |
| 3 | 6 | MAIN PULSE + SUPPLEMENTAL PULSE | ○ |
| 4 | 9 | MAIN PULSE + SUPPLEMENTAL PULSE | ○ |
| 5 | 11 | MAIN PULSE + SUPPLEMENTAL PULSE | ○ |
| 6 | 14 | MAIN PULSE + SUPPLEMENTAL PULSE | ○ |
| 7 | 17 | MAIN PULSE + SUPPLEMENTAL PULSE | ○ |
| 8 | 27 | MAIN PULSE + SUPPLEMENTAL PULSE | ○ |
| 9 | 30 | MAIN PULSE + SUPPLEMENTAL PULSE | ○ |
| 10 | 34 | MAIN PULSE + SUPPLEMENTAL PULSE | - |
| 11 | 43 | MAIN PULSE + SUPPLEMENTAL PULSE | - |
| 12 | 50 | MAIN PULSE + SUPPLEMENTAL PULSE | - |
| 13 | 56 | MAIN PULSE + SUPPLEMENTAL PULSE | - |
| 14 | 62 | MAIN PULSE + SUPPLEMENTAL PULSE | - |
| 15 | 66 | MAIN PULSE + SUPPLEMENTAL PULSE | - |
| 16 | 72 | MAIN PULSE + SUPPLEMENTAL PULSE | - |
| 17 | 76 | MAIN PULSE + SUPPLEMENTAL PULSE | - |
| 18 | 81 | MAIN PULSE + SUB-PULSE (SUPPLEMENTAL PULSE + PREHEAT PULSE) | - |
| 19 | 87 | MAIN PULSE + SUB-PULSE (SUPPLEMENTAL PULSE + PREHEAT PULSE) | - |
| 20 | 93 | MAIN PULSE + SUB-PULSE (SUPPLEMENTAL PULSE + PREHEAT PULSE) | - |
| 21 | 98 | MAIN PULSE + SUB-PULSE (SUPPLEMENTAL PULSE + PREHEAT PULSE) | - |
| 22 | 102 | MAIN PULSE + SUB-PULSE (SUPPLEMENTAL PULSE + PREHEAT PULSE) | - |
| 23 | 106 | MAIN PULSE + SUB-PULSE (SUPPLEMENTAL PULSE + PREHEAT PULSE) | - |
| 24 | 110 | MAIN PULSE + SUB-PULSE (SUPPLEMENTAL PULSE + PREHEAT PULSE) | - |
| 25 | 114 | MAIN PULSE + SUB-PULSE (SUPPLEMENTAL PULSE + PREHEAT PULSE) | - |

FIG. 22

ACCELERATION-DECELERATION TABLE

| PRINT SPEED | | PRESENT SPEED | | | | | | | | | | | | | | | | | | | | | | | | | |
|---|---|---|---|---|---|---|---|---|---|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| TARGET SPEED | 0 | 0 | 0 | 0 | 0 | 0 | 0 | 0 | 0 | 0 | 0 | 0 | 6 | 8 | 10 | 11 | 12 | 14 | 15 | 16 | 17 | 18 | 19 | 20 | 21 | 22 | 23 |
| | 1 | 1 | 1 | 1 | 1 | 1 | 1 | 1 | 1 | 1 | 1 | 1 | 6 | 8 | 10 | 11 | 12 | 14 | 15 | 16 | 17 | 18 | 19 | 20 | 21 | 22 | 23 |
| | 2 | 2 | 2 | 2 | 2 | 2 | 2 | 2 | 2 | 2 | 2 | 2 | 6 | 8 | 10 | 11 | 12 | 14 | 15 | 16 | 17 | 18 | 19 | 20 | 21 | 22 | 23 |
| | 3 | 3 | 3 | 3 | 3 | 3 | 3 | 3 | 3 | 3 | 3 | 3 | 6 | 8 | 10 | 11 | 12 | 14 | 15 | 16 | 17 | 18 | 19 | 20 | 21 | 22 | 23 |
| | 4 | 4 | 4 | 4 | 4 | 4 | 4 | 4 | 4 | 4 | 4 | 4 | 6 | 8 | 10 | 11 | 12 | 14 | 15 | 16 | 17 | 18 | 19 | 20 | 21 | 22 | 23 |
| | 5 | 5 | 5 | 5 | 5 | 5 | 5 | 5 | 5 | 5 | 5 | 5 | 6 | 8 | 10 | 11 | 12 | 14 | 15 | 16 | 17 | 18 | 19 | 20 | 21 | 22 | 23 |
| | 6 | 6 | 6 | 6 | 6 | 6 | 6 | 6 | 6 | 6 | 6 | 6 | 6 | 8 | 10 | 11 | 12 | 14 | 15 | 16 | 17 | 18 | 19 | 20 | 21 | 22 | 23 |
| | 7 | 7 | 7 | 7 | 7 | 7 | 7 | 7 | 7 | 7 | 7 | 7 | 7 | 8 | 10 | 11 | 12 | 14 | 15 | 16 | 17 | 18 | 19 | 20 | 21 | 22 | 23 |
| | 8 | 8 | 8 | 8 | 8 | 8 | 8 | 8 | 8 | 8 | 8 | 8 | 8 | 8 | 10 | 11 | 12 | 14 | 15 | 16 | 17 | 18 | 19 | 20 | 21 | 22 | 23 |
| | 9 | 9 | 9 | 9 | 9 | 9 | 9 | 9 | 9 | 9 | 9 | 9 | 9 | 9 | 10 | 11 | 12 | 14 | 15 | 16 | 17 | 18 | 19 | 20 | 21 | 22 | 23 |
| | 10 | 10 | 10 | 10 | 10 | 10 | 10 | 10 | 10 | 10 | 10 | 10 | 10 | 10 | 10 | 11 | 12 | 14 | 15 | 16 | 17 | 18 | 19 | 20 | 21 | 22 | 23 |
| | 11 | 10 | 10 | 10 | 10 | 10 | 10 | 10 | 10 | 10 | 11 | 11 | 11 | 11 | 11 | 11 | 12 | 14 | 15 | 16 | 17 | 18 | 19 | 20 | 21 | 22 | 23 |
| | 12 | 10 | 10 | 10 | 10 | 10 | 10 | 10 | 10 | 10 | 12 | 12 | 12 | 12 | 12 | 12 | 12 | 14 | 15 | 16 | 17 | 18 | 19 | 20 | 21 | 22 | 23 |
| | 13 | 10 | 10 | 10 | 10 | 10 | 10 | 10 | 10 | 10 | 12 | 13 | 13 | 13 | 13 | 13 | 13 | 14 | 15 | 16 | 17 | 18 | 19 | 20 | 21 | 22 | 23 |
| | 14 | 10 | 10 | 10 | 10 | 10 | 10 | 10 | 10 | 10 | 12 | 13 | 14 | 14 | 14 | 14 | 14 | 14 | 15 | 16 | 17 | 18 | 19 | 20 | 21 | 22 | 23 |
| | 15 | 10 | 10 | 10 | 10 | 10 | 10 | 10 | 10 | 10 | 12 | 13 | 14 | 15 | 15 | 15 | 15 | 15 | 15 | 16 | 17 | 18 | 19 | 20 | 21 | 22 | 23 |
| | 16 | 10 | 10 | 10 | 10 | 10 | 10 | 10 | 10 | 10 | 12 | 13 | 14 | 15 | 16 | 16 | 16 | 16 | 16 | 16 | 17 | 18 | 19 | 20 | 21 | 22 | 23 |
| | 17 | 10 | 10 | 10 | 10 | 10 | 10 | 10 | 10 | 10 | 12 | 13 | 14 | 15 | 16 | 16 | 17 | 17 | 17 | 17 | 17 | 18 | 19 | 20 | 21 | 22 | 23 |
| | 18 | 10 | 10 | 10 | 10 | 10 | 10 | 10 | 10 | 10 | 12 | 13 | 14 | 15 | 16 | 16 | 17 | 18 | 18 | 18 | 18 | 18 | 19 | 20 | 21 | 22 | 23 |
| | 19 | 10 | 10 | 10 | 10 | 10 | 10 | 10 | 10 | 10 | 12 | 13 | 14 | 15 | 16 | 16 | 17 | 18 | 18 | 19 | 19 | 19 | 19 | 20 | 21 | 22 | 23 |
| | 20 | 10 | 10 | 10 | 10 | 10 | 10 | 10 | 10 | 10 | 12 | 13 | 14 | 15 | 16 | 16 | 17 | 18 | 18 | 19 | 20 | 20 | 20 | 20 | 21 | 22 | 23 |
| | 21 | 10 | 10 | 10 | 10 | 10 | 10 | 10 | 10 | 10 | 12 | 13 | 14 | 15 | 16 | 16 | 17 | 18 | 18 | 19 | 20 | 21 | 21 | 21 | 21 | 22 | 23 |
| | 22 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 22 | 22 | 22 | 23 |
| | 23 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 23 | 23 | 23 |
| | 24 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 24 | 24 | 24 |
| | 25 | 10 | 10 | 10 | 10 | 10 | 10 | 10 | 10 | 10 | 12 | 13 | 14 | 15 | 16 | 16 | 17 | 18 | 18 | 19 | 20 | 21 | 22 | 23 | 24 | 25 | 25 |

PRINTING DEVICE

CROSS REFERENCE TO RELATED APPLICATIONS

The present application claims priority from Japanese Patent Application No. JP 2014-074309, which was filed on Mar. 31, 2014, and Application No. JP 2014-082886, which was filed on Apr. 14, 2014, the disclosure of which is incorporated herein by reference in its entirety.

TECHNICAL FIELD

The present disclosure relates to a printing device in which a desirable print formation is done on a print medium.

Conventionally, in a printing device in which a desirable print formation is done on a print medium, when it is necessary to add simultaneously print pulses to a plurality of heat elements of a thermal head, for instance, under condition that ruled lines or black areas are printed, it is conducted divisional printing explained below.

In the divisional printing, a divisional number is determined according to the maximum value of on-dot number defined by a total number of heat elements to which print pulses are simultaneously added in a thermal head, and print pulses are added to the heat elements of thermal head every each of a plurality of divided heating areas, along a main scanning direction intersecting a feed direction of the print medium at right angle based on the above divisional number.

When the above divisional printing is conducted, the feed speed of print medium goes down to a comparatively low speed.

Here, among print pulses added to the heat elements of thermal head, there exists a main pulse to conduct color development on the print medium and a sub-pulse to supplement the main pulse.

Furthermore, the sub-pulse includes a supplemental pulse, which cannot conduct color development on the print medium when added alone but can conduct color development on the print medium by supplementing the main pulse added during the present print period, and a preheat pulse, which cannot conduct color development on the print medium when added alone but can conduct color development on the print medium by supplementing the main pulse added during the next print period.

Especially, in case that the heat elements to which the preheat pulses are added, are included in count object of on-dot number of dots which are simultaneously heated on in determination of the divisional number, it may be conceivable that a number of times that divisional printing is done increase. Accordingly, it may be conceivable that feed speed of the print medium becomes comparatively slow and such time becomes long. As a result, it may occur a case that realization of fast print is difficult.

SUMMARY

The disclosure has been made to solve the above-described problem and has an object to provide a printing device in which fast print can be realized even if the supplemental pulse or preheat pulse is utilized in the printing device in which divisional printing may occur.

To achieve the purpose of the disclosure, there is provided a printing device comprising: a thermal head provided with a line head in which a plurality of heat elements are linearly lined up; a feeding device for feeding a thermal print medium in a sub-scanning direction normal to the line head of the thermal head; a control device for controlling the feeding device and the thermal head; wherein the control device conducts batch processing or divisional processing of pulse addition to selectively heat the heat elements in the line head of the thermal head in a main scanning direction parallel with the line head every a print period continuously repeated, thereby printing of print dots is done on the thermal print medium fed in sub-scanning direction by the feeding device in accordance with a feed speed corresponding to the batch processing or a feed speed corresponding to the divisional processing, wherein a main pulse adding time of the main pulse to color-develop the thermal print medium and a sub-pulse adding time to supplement the main pulse are retained in each of the print period, wherein the sub-pulse is a supplemental pulse color-developing the thermal print medium by supplementing the main pulse added in a present print period, the supplemental pulse not being able to color-develop the thermal print medium by itself or a preheat pulse to color-develop the thermal print medium by supplementing the main pulse added in a next print period, the preheat pulse not being able to color-develop the thermal print medium by itself, wherein the control device counts a total number of the main pulse every print period within a first predetermined range, and when a maximum value of the total number of the main pulse exceeds a first threshold value, the divisional processing is conducted by adding the main pulse and the supplemental pulse every the print period within a second predetermined range smaller than the first predetermined range in accordance with the feed speed corresponding to the divisional processing, wherein when the maximum value of the total number of the main pulse does not exceed the first threshold, the control device counts a total number of the supplemental pulse every the print period within the first predetermined range, and when the maximum value of the total value of the supplemental pulse exceeds a second threshold value, the batch processing is conducted by adding the main pulse and the supplemental pulse every the print period within the second predetermined range in accordance with the feed speed corresponding to the batch processing, and wherein when the total value of the supplemental pulse does not exceed the second threshold value, the batch processing is conducted by adding the main pulse and the supplemental pulse every the print period within the second predetermined range at the feed speed corresponding to the batch processing and the batch processing is conducted by adding the main pulse, the supplemental pulse and the preheat pulse every the print period within the second predetermined range while the feed speed shifts to a maximum speed by exceeding the feed speed corresponding to the batch processing.

Here, "color development" is not limited to color development occurring in heat-sensitive printing and includes color development occurring in thermal transcription printing. Further, "first threshold value" and "second threshold value" may be equal.

BRIEF DESCRIPTION OF THE DRAWINGS

FIG. 5 is a preset line number table stored in ROM.

FIG. 6 is a dot-number table stored in ROM.

FIG. 7 is a table indicating a relation between speed and printing stored in ROM.

FIG. 8 is an acceleration-deceleration table stored in ROM.

FIG. 21 is a table indicating a relation between speed and printing stored in ROM.

FIG. 22 is an acceleration-deceleration table stored in ROM.

DETAILED DESCRIPTION

A detailed description of an exemplary embodiment of the printing device embodying the disclosure will now be given referring to the accompanying drawings.

Hereinafter, one embodiment of the present disclosure will be explained with reference to drawings.

[Construction of Printing Device]

Figure 1:
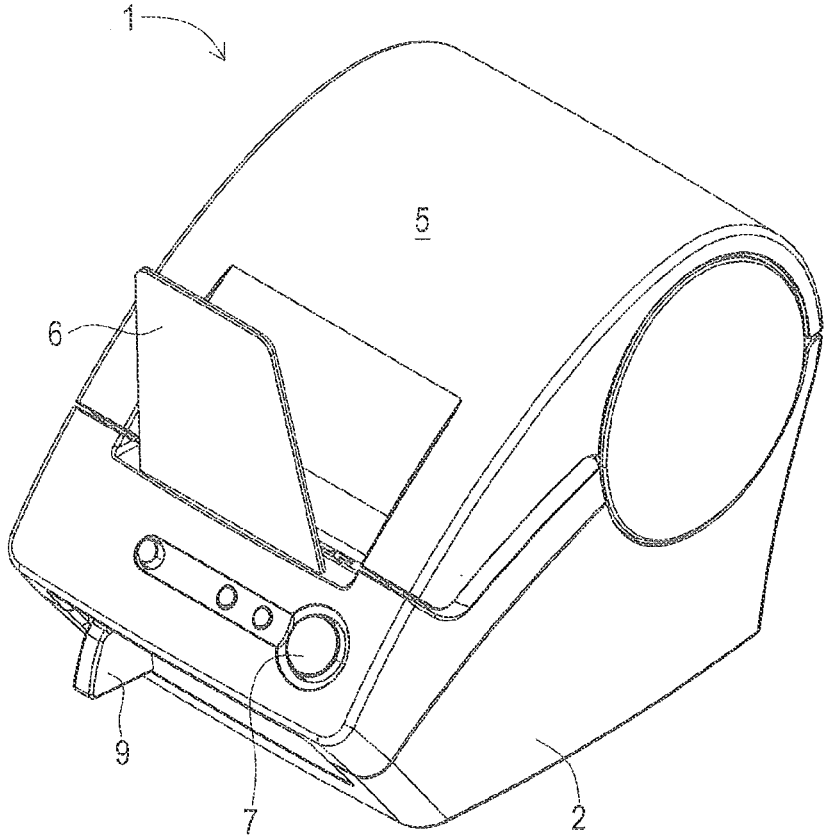
FIG. 1 is a perspective view indicating an outline of a printing device according to one embodiment of the disclosure.

An outline construction of one embodiment according to the present disclosure will be described with reference to FIGS. 1 to 3. As shown in FIG. 1, the printing device 1 of the embodiment has a case 2 and an upper cover 5. In front of the case 2, a resin-made tray 6 is up-raised at a front end portion continuing to the upper cover 5, and a power button 7 is arranged at a forward position of the tray 6. Under the power button 7, a cutter lever 9 to operate a cutter unit 8 (see FIG. 3) and conduct cutting operation is arranged. The cutter lever 9 is provided so as to be movable in a width direction of the case 2 (right and left direction).

Figure 2:
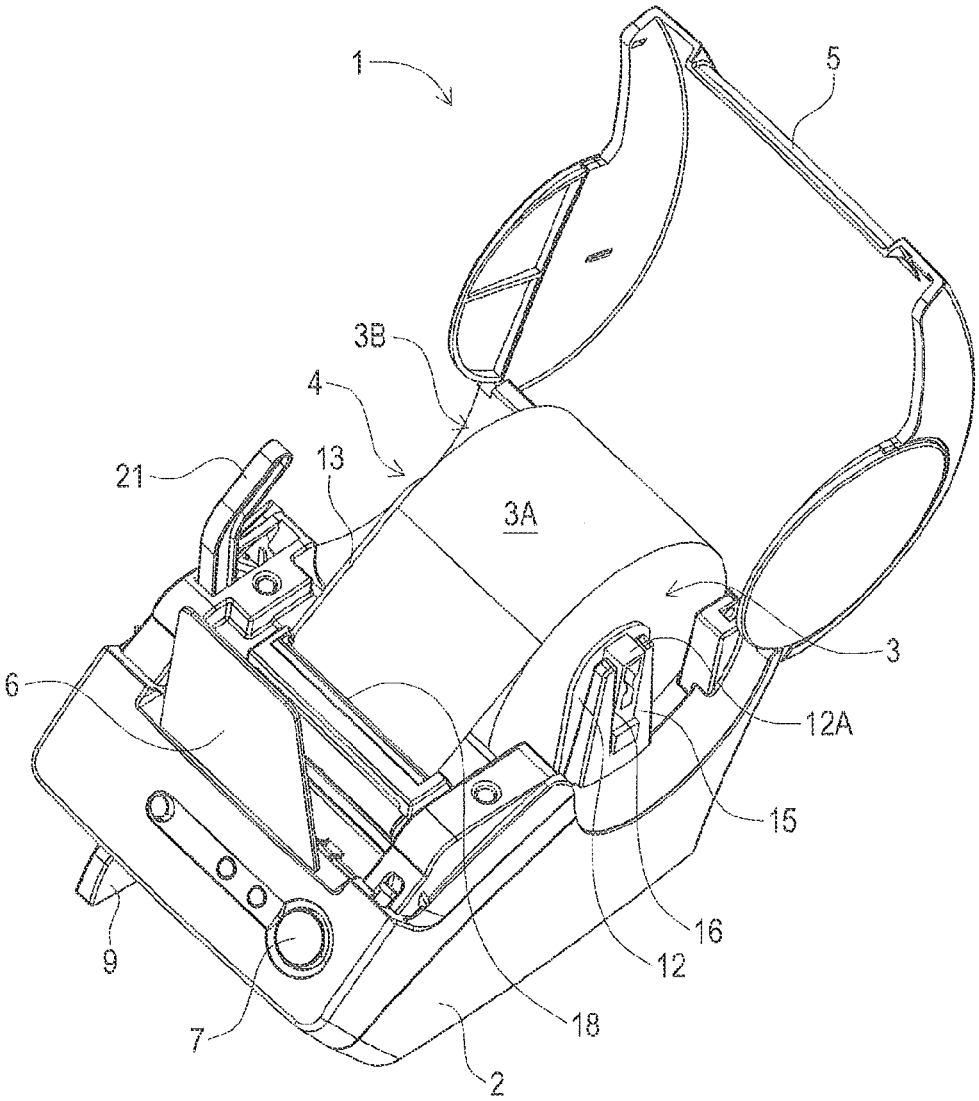
FIG. 2 is a perspective view of the printing device when an upper cover is open.

As shown in FIG. 2, at left side of the case 2, an operation lever 21 to lift-up and lift-down a thermal head 23 (see FIG. 3) is provided so as to be rotatable in up and down direction. At rear side of the case 2, a power supply code 10 (see FIG. 3) is connected and connector portion (not shown) constructed from USB (Universal Serial Bus) used for connecting with a personal computer 26 (see FIG. 4) and so on is provided. The upper cover 5 is connected to the case 2 at the rear end portion thereof, so that the upper cover 5 becomes rotatable, thereby the upper cover 5 has structure so as to be able to open and close the case 2.

As shown in FIGS. 1 and 2, the printing device 1 has a holder storing portion 4 formed in a concave shape arranged at a rear position of inner space of the case 2. On the holder storing portion 4, a roll holder 3B in which a roll 3 of print tape 3A (print medium) is provided, is stored so that roll width direction of the roll 3 coincides with a width direction of the case 2 and the print tape 3A is fed from the upper side thereof. The print tape 3A is formed from a long thermal sheet (so-called, thermal paper) having printing layer with self-coloring ability or a long label sheet on one side of which a release sheet is stacked through an adhesive layer for adhering to an object body. Such print sheet 3A is rolled around a roll core, thereby the roll 3 is formed.

The roll holder 3B has a guide member 13 arranged at one side (left side in FIG. 2) in the width direction of the roll 3, a retaining member 12 arranged at the other side (right side in FIG. 2) in the width direction of the roll 3 and a shaft member (not shown) connecting the retaining member 12 and the guide member 13. The roll core of the roll 3 is inserted in the shaft member while the guide member 13 is detached. The guide member 13 is fixed to one side end portion of the roll core protruded from the shaft member in the width direction of the roll 3. Thereby, the one side end portion in the width direction of the roll 3 is contacted with the guide member 13 and the roll 3 is rotatably disposed to the roll holder 3B around the shaft member, while the other side end portion of the roll 3 is contacted with the retaining member 12.

The guide member 13 of roll holder 3B has a guide portion 13A for guiding the print tape 3A which is repeatedly fed from the roll 3, the guide portion 13A being extended to a tape feed direction. A lower end of the guide portion 13A is formed so as to a horizontal plane. On the other hand, at a front of the holder storing portion 4, a horizontal portion 20 to put the guide portion 13A thereon is formed. At the other end side of the holder storing portion 4 in the roll width direction, as shown in FIG. 2, a holder support member 15 is stood up, the holder support member 15 having a positioning groove 16 with a long-hole shape opened in upward direction. When the roll holder 3B is inserted in the holder storing portion 4, the guide portion 13A of the guide member 13 is put on the horizontal portion 20 of the holder storing portion 4 and a protrusive portion 12A horizontally protruded from the retaining member 12 is fit in the positioning groove 16 formed in the holder support member 15. Thereby, the roll holder 3A is detachably mounted in the holder storing portion 4.

Figure 3:
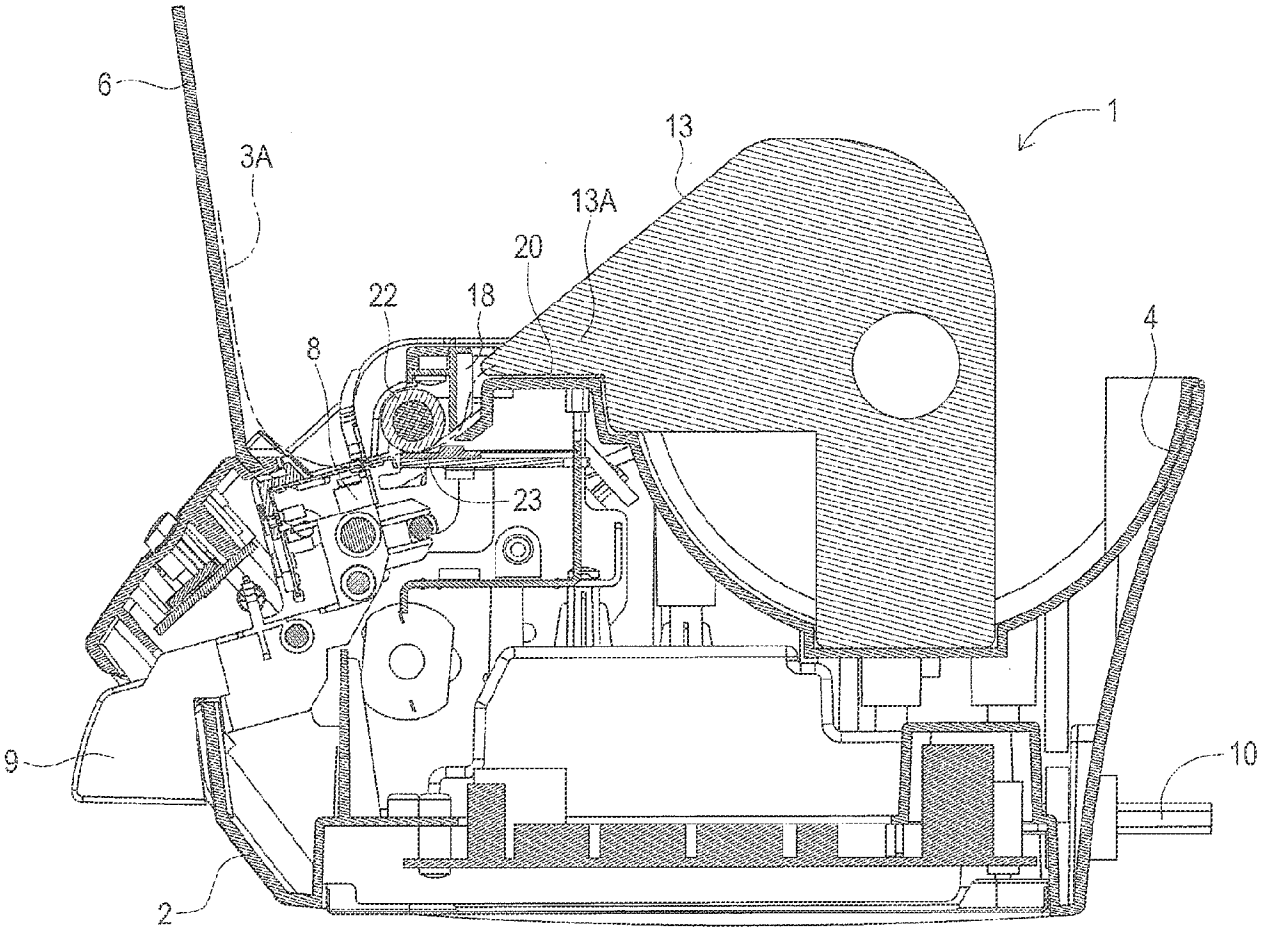
FIG. 3 is a side cross section along a front-rear direction of the printing device.

As shown in FIG. 3, at a downstream side in the tape feed direction of the horizontal portion 20 formed in the front part of the holder storing portion 4, the thermal head 23 is positioned which is arranged so as to be able to move up and down direction. At an upper direction of the thermal head 23, a platen roller 22 is positioned so as to face to the thermal head 23. The front portion of the holder storing portion 4 forward extends while bending toward the lower direction and continues to an insertion opening 18 to insert the print tape 3A rewound and fed from the roll 3 into a space where the platen roller 22 and the thermal head 23 are faced each other.

Figure 4:
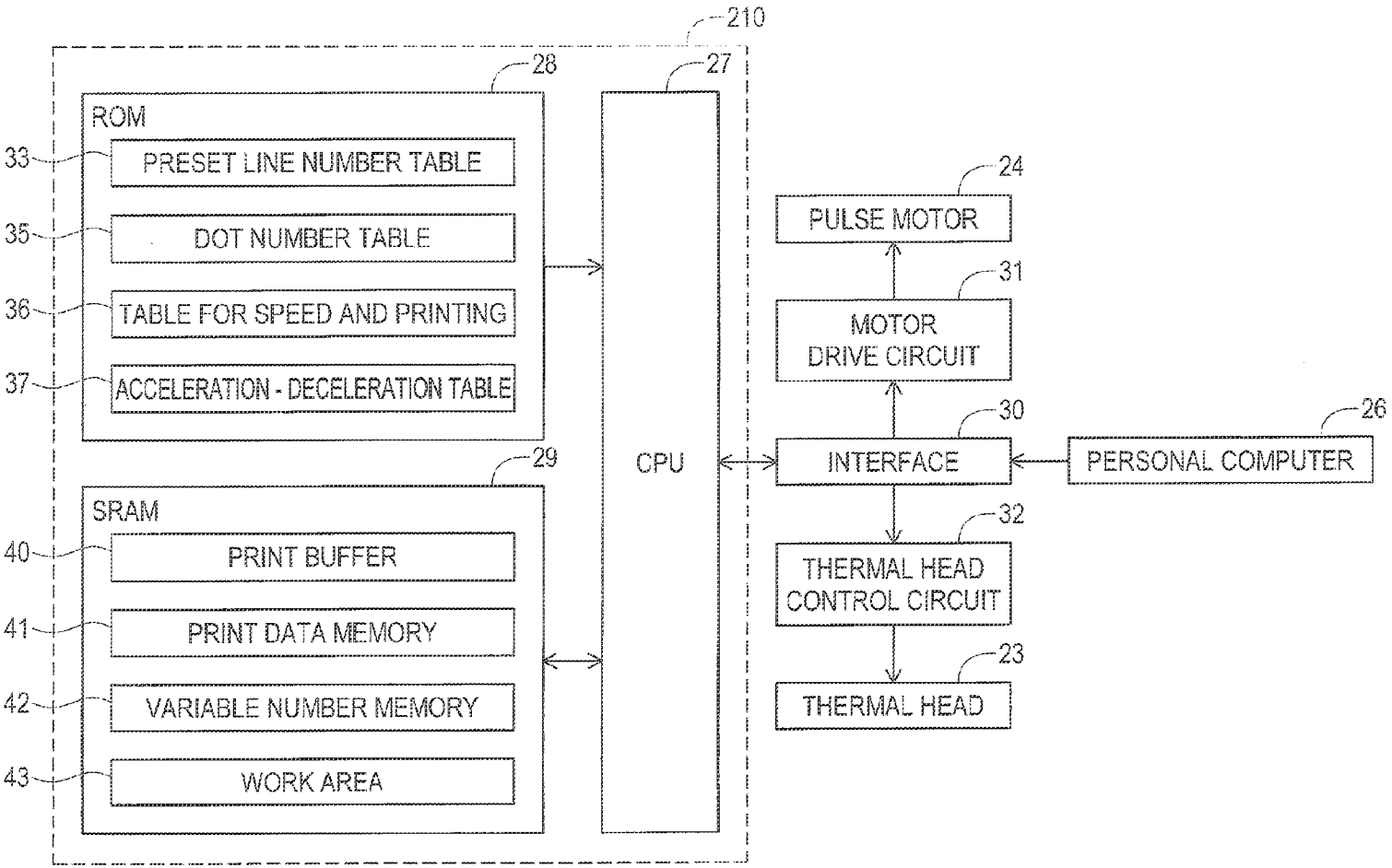
FIG. 4 is a functional block diagram indicating a control system of the printing device.

The platen roller 22 grasps the print tape 3A from the roll 3 in cooperation with the thermal head 23 moved upward and feeds the print tape 3A by being driven to rotate through a pulse motor 24 (see FIG. 4).

Figure 15:
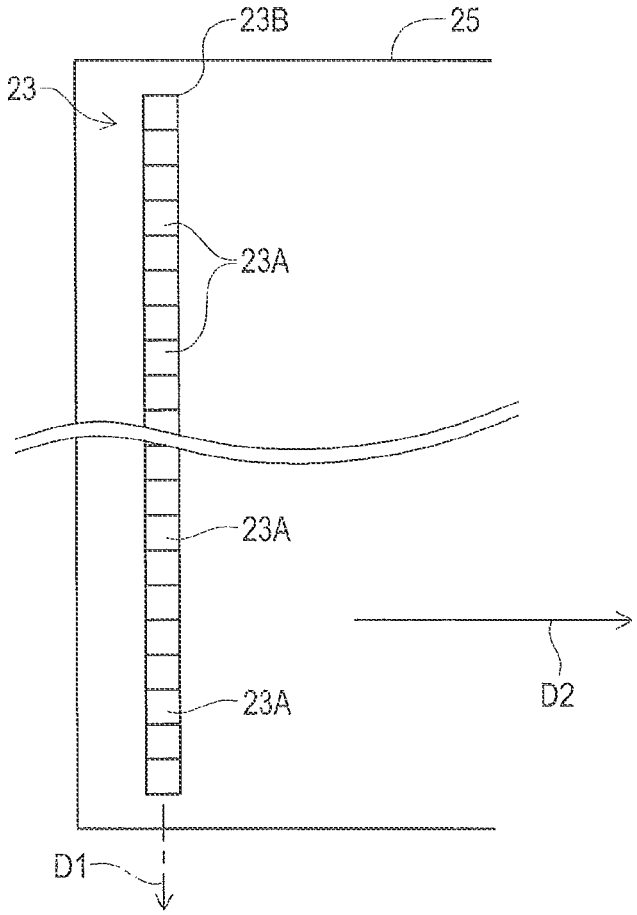
FIG. 15 is an enlarged view of a thermal head.

The thermal head 23 forms dots on each of print lines which are sectioned according to print resolution in the tape feed direction of the print tape 3A. That is to say, as shown in FIG. 15, the thermal head 23 has a plurality of heat elements 23A (360 elements) arranged parallel with a main-scanning direction D1 normal to a sub-scanning direction D2 coinciding with the tape feed direction. The thermal head 23 is constructed from a line head 23B in which 360 heat elements 23A are arranged in one line and a plate 25 on which the line head 23B is provided.

Returning to FIGS. 2 and 3, description will be continued. The thermal head 23 conducts printing based on image data on a print layer (lower surface) of the print tape 3A grasped by the platen roller 22 therebetween by electrically turning on the heat elements 23A (see FIG. 15) based on the image data. Here, the thermal head 23 is moved downward by rotating upward the operation lever 21 arranged at the left side of the case 2, thereby the thermal head 23 separates from the platen roller 22. Contrarily, when the operation lever 21 is rotated downward, the thermal head 23 is moved upward and contacted with the platen roller 22 through the print tape 3A therebetween, thereby the printer 1 becomes a printable state.

At the downstream side in the tape feed direction from the thermal head 23, the cutter unit 8 is arranged which is movable in the width direction of the print tape 3A. After printing is done by the thermal head 23 and the cutter lever 9 is moved in the width direction of the case 2. Thereby, the cutter unit 8 moves in the width direction of the print tape 3A and cuts the print tape 3A in the width direction of the print tape 3A after printing is done on the print tape 3A and the print tape 3A is discharged on the tray 6.

[Print Operation]

Hereinafter, print operation of the printing device 1 will be described. First, the operation lever 21 is rotated upward and the thermal head 23 is positioned in a state that the thermal head 23 is separated downward from the platen roller 22. In this state, the roller holder 3B on which the roll 3 is provided is put on the holder storing portion 4 and the protrusive portion 12A of the retaining member 12A in the roll holder 3B is fit into the positioning groove 16 of the holder support member 15. Thereafter, the lower surface of the guide portion 13A of the guide member 13 in the roll holder 3A is contacted with the horizontal portion 20 and the roll holder 3A in which the roll 3 is set is stored detachably from the holder storing portion 4.

Thereafter, while end portion at one side in the width direction of the print tape 3A is contacted with inner side of the guide member 13, the print tape 3A is derived from the roll 3 and while the other end portion in the width direction of the derived print tape 3A is contacted with the other side peripheral in the roll width direction of the insertion opening 18, the print tape 3A is inserted in the insertion opening 18. The top portion of the print tape 3A in the tape feed direction is positioned between the platen roller 22 and the thermal head 23. Thereafter, the upper cover 5 is closed so as to cover the upper side of the holder storing portion 4 (see the state shown in FIG. 1).

When the upper cover 5 is closed, the upper cover 5 presses the operation lever 21, thereby the operation lever 21 rotates downward and the thermal head 23 is positioned in a state that the thermal head 23 depresses the print tape 3A onto the platen roller 22. When the platen roller 22 is driven to rotate by the pulse motor 24 (see FIG. 4), the print tape 3A is fed by the platen roller 22. Thereafter, when the heat elements 23A (see FIG. 25) on the thermal head 23 are electrically turned on, printing is serially conducted on the print layer of the print tape 3A by the heat elements 23A (see FIG. 15) based on the image data. The print tape 3A passed through the thermal head 23 is discharged to the tray 6 through a clearance between the upper cover 5 and the case 2. At a time that printing onto the print tape 3A is done and discharged length of the print tape 3A from the cutter unit 8 becomes a predetermined length, the cutter lever 9 is operated and moved to the rightward direction. Thereby, the print tape 3A is cut in the width direction thereof and a label (printed tape), on which predetermined printing is done, with a predetermined length is formed.

Figure 13:
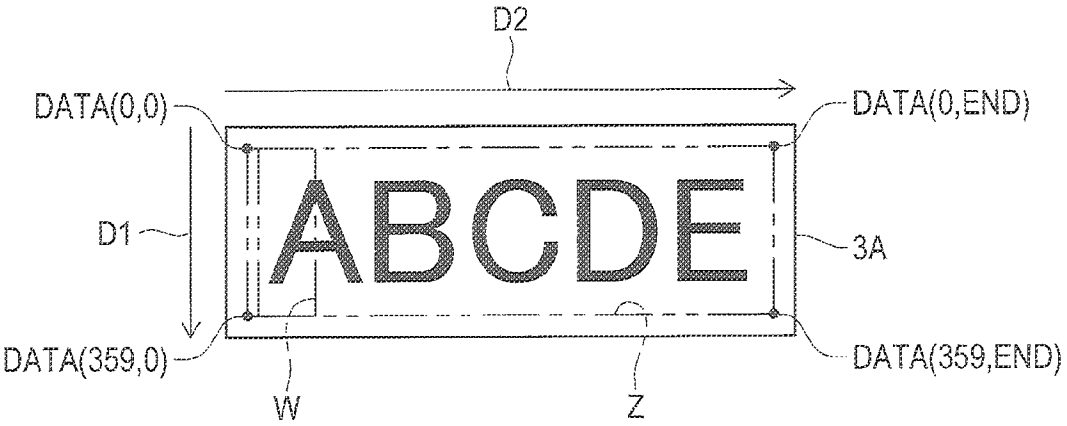
FIG. 13 is an explanatory view indicating a printed example of print tape.

Here, on the print tape 3A shown in FIG. 13, English characters "ABCD" are printed. The width direction of the print tape 3A corresponds to the main-scanning direction D1 parallel with the arrangement direction of the heat elements 23A (see FIG. 15) of the thermal head 23. The feed direction of the print tape 3A is the sub-scanning direction D2 perpendicular to the arrangement direction of the heat elements 23A (see FIG. 15) of the thermal head 23.

[Control System]

Hereinafter, the control system of the printing device 1 according to the embodiment will be described with reference to FIG. 4. In FIG. 4, a control circuit 210 is arranged in the control system of the printing device 1. In the control circuit 210, CPU 27, ROM 28 and SRAM 29 are connected to the CPU 27. To the CPU 27, motor drive circuit 31 and thermal head control circuit 32 are connected through interface 30. Further, to the CPU 27, personal computer 26 as an outer device is connected. To the motor drive circuit 31, the pulse motor 24 is connected and to the thermal head control circuit 32, the thermal head 23 is connected. Here, in the present embodiment, as for the pulse motor 24, it will be described according to a case that the pulse motor 24 corresponds to "1 line-2 motor pulses". That is to say, "1 line-2 motor pulses" means a case that when 2 motor pulses are added to the pulse motor 24, the print tape 3A is fed by only 1 line of the print lines based on print resolution in the tape feed direction by rotation of the platen roller 22. However, the pulse motor 24 is not limited to "1 line-2 motor pulses" and another correspondence relation such as "1 line-1 motor pulse" and so on may be conceivable.

In the ROM 28, a preset line number table 33, a dot number table 35, a table for speed and printing 36 and an acceleration-deceleration table 37 are stored therein. Here, these preset line number table 32, dot number table 35, table 36 for speed and printing and acceleration-deceleration table 37 will be described hereinafter.

Further, in the ROM 28, programs of flowcharts represented in FIGS. 9-12, 23 and 24 will be described hereinafter.

SRAM 29 is a temporary memory for temporarily storing data necessary to conduct data process by the CPU 27, and the SRAM 29 has a print buffer 40, a print data memory 41 and a work area 43.

In the print buffer 40, image data transmitted from the personal computer 26 is stored. The image data is a two-dimensional data groups in which, in a print area Z shown in FIG. 13, the dot color-developed on a print line (abbreviated as "color-development dot" hereinafter) is represented as "1" and the dot non-color-developed on a print line (abbreviated as "non-color-development dot" hereinafter) is represented as "0". In the embodiment, the two-dimensional data groups are specified through coordinate DATA(X, Y) within the print area Z.

The coordinate DATA(X, Y) in the print area Z is represented based on that the main-scanning direction D1 is X direction, the sub-scanning direction D2 is Y direction, and the left upper corner in the print area Z is origin DATA(0,0). Here, 360 heat elements on the thermal head 23 (see FIG. 15) are arranged parallel with the X direction corresponding to the main-print scanning direction. The left side of the print area Z corresponds to the first print line and the right side (downstream side in the tape feed direction) of the print area Z corresponds to the last print line. Further, position in Y direction on the first print line is represented as "0". In the embodiment, position on the last print line in Y-direction is represented as the variable "END". Based on the above, as shown in FIG. 13, the position of left upper corner in the print area Z is represented as DATA(0,0), the position of left lower corner in the print area Z is represented as DATA(359,0), the position of right upper corner in the print area Z is represented as DATA(0, END) and the position of right lower corner in the print area Z is represented as DATA(359, END).

Figure 10:
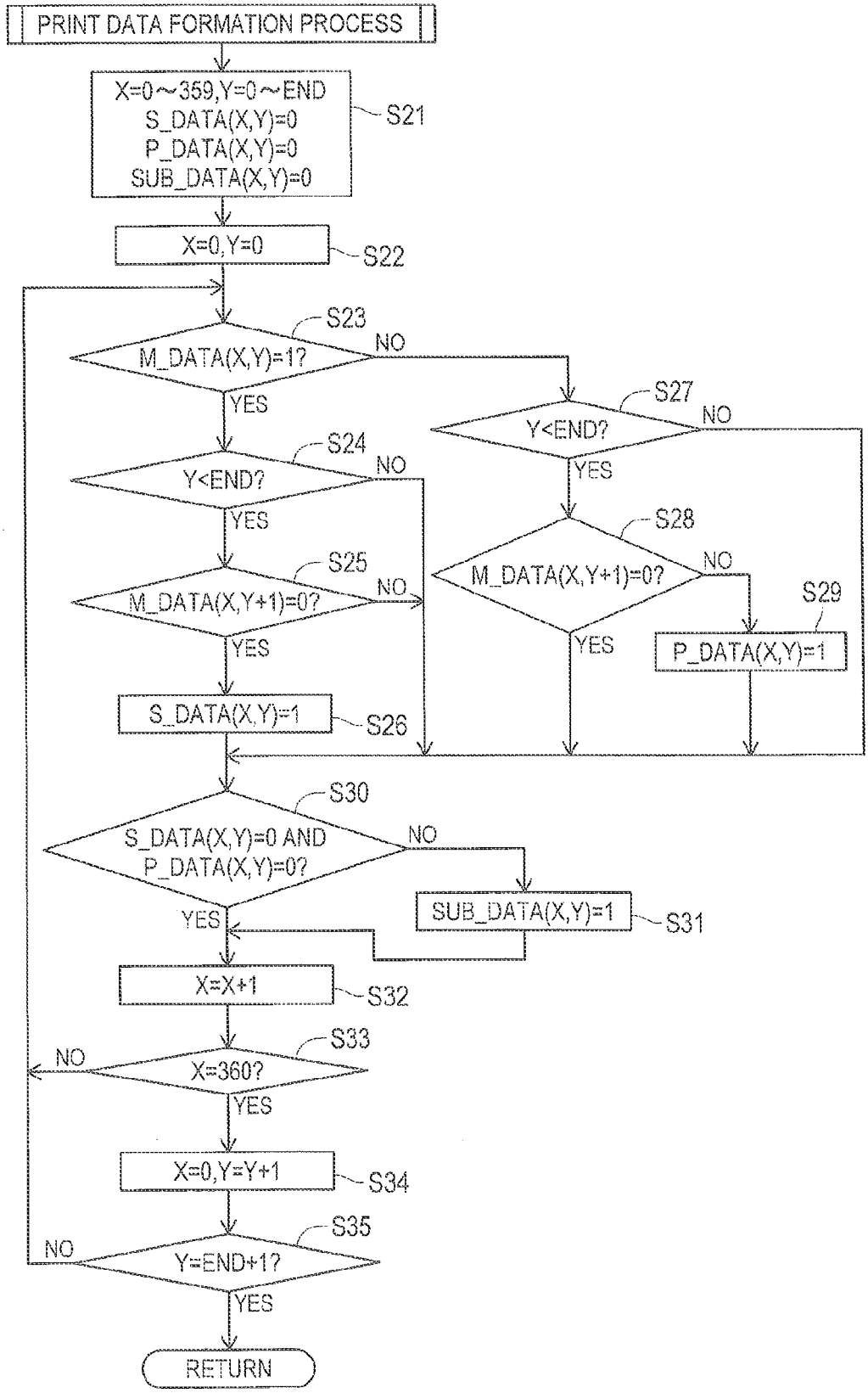
FIG. 10 is a sub-flowchart indicating control procedure executed by CPU.

Returning to FIG. 4, a print data memory 41 stores main data M_DATA(X, Y), supplemental data S_DATA(X, Y), preheat data P_DATA(X, Y) and sub-data SUB_DATA(X, Y), these data being used and formed in the flowchart in FIG. 10.

The main data M_DATA(X, Y) is the two-dimensional data groups in which the dot on the print line in the print area Z (see FIG. 13) that a main pulse is added is represented as "1", the dot on the print line in the print area Z (see FIG. 13) that the main pulse is not added is represented as "0", both dots being represented by the coordinate DATA(X, Y) within the print area Z. As mentioned later, the dot on the print line to which the main pulse is added is the "color-development dot" and the dot on the print line to which the main pulse is not added is the "non-color-development dot". Thus, the main data M_DATA(X, Y) coincides with the image data as the two-dimensional data groups transmitted from the personal computer 26.

The supplemental data S_DATA(X, Y) is the two-dimensional data groups in which the dot on the print line in the print area Z (see FIG. 13) that a supplemental pulse is added is represented as "1", the dot on the print line in the print area Z (see FIG. 13) that the supplemental pulse is not added is represented as "0", both dots being represented by the coordinate DATA(X, Y) within the print area Z. The preheat DATA P_(X, Y) is the two-dimensional data groups in which the dot on the print line in the print area Z (see FIG. 13) that a preheat pulse is added is represented as "1", the dot on the print line in the print area Z (see FIG. 13) that the preheat pulse is not added is represented as "0", both dots being represented by the coordinate DATA(X, Y) within the print area Z. The sub-data SUB_DATA(X, Y) is the two-dimensional data groups in which the dot on the print line in the print area Z (see FIG. 13) that the sub-pulse is added is represented as "1", the dot on the print line in the print area Z (see FIG. 13) that the sub-pulse is not added is represented as "0", both dots being represented by the coordinate DATA(X, Y) within the print area Z.

The main pulse, the supplemental pulse, the preheat pulse and the sub-pulse will be described with reference to FIGS. 16 to 18.

Figure 16:
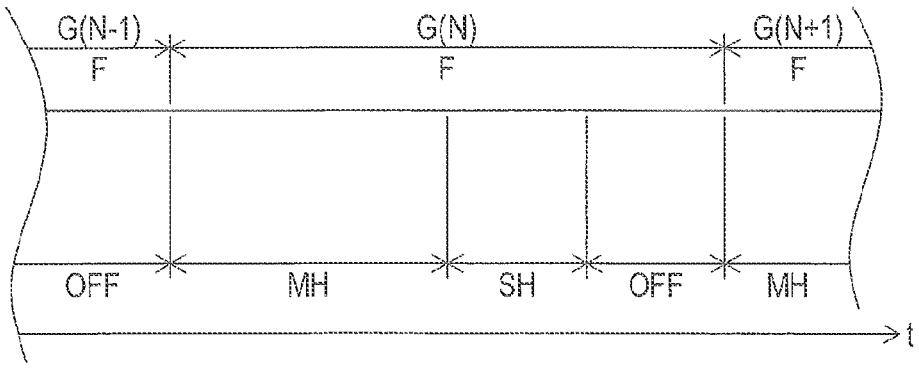
FIG. 16 is an explanatory view indicating a print period.
Figure 17:
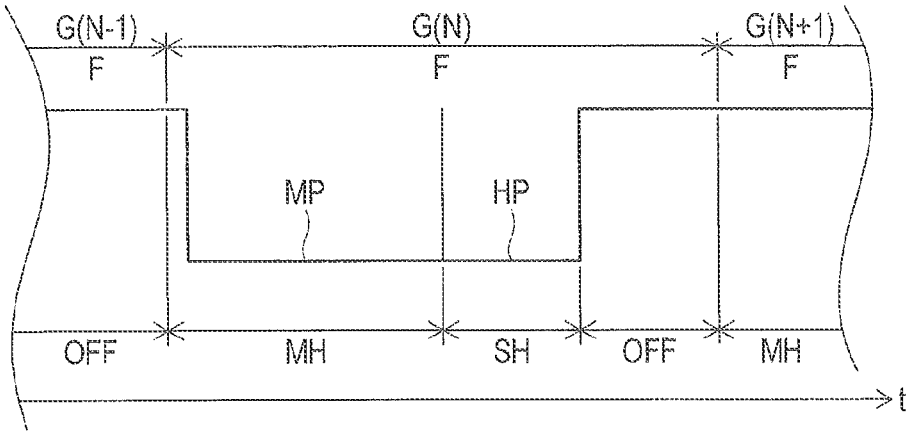
FIG. 17 is an explanatory view indicating the main pulse and the supplemental pulse.
Figure 18:
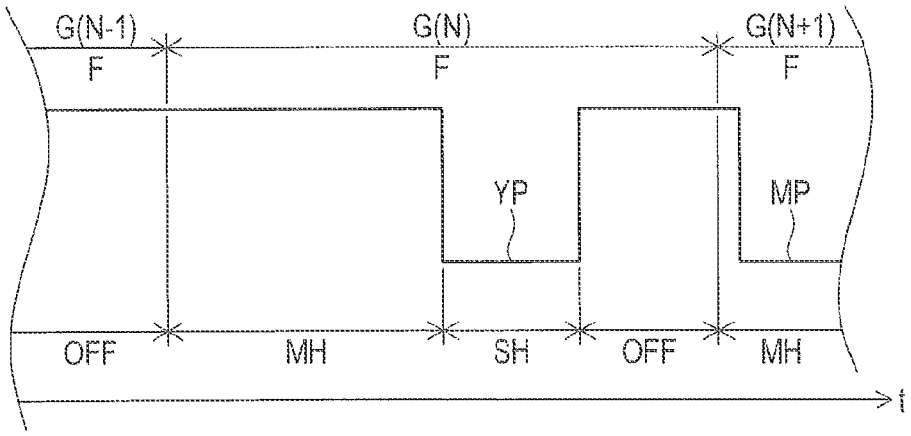
FIG. 18 is an explanatory view of the main pulse and the preheat pulse.

In FIGS. 16 to 18, a time axis is represented as "t" and a print period for one print line is represented as "F".

In FIG. 16, G(N) indicates a print period of dot positioned at a position represented coordinate DATA(X, Y) within the print area Z (see FIG. 13) among dots existing on the present print line.

G(N−1) indicates a print period of dot positioned at a position represented coordinate DATA(X, Y−1) within the print area Z (see FIG. 13) among dots existing on the previous print line. That is to say, the dot corresponding to the previous print period G(N−1) positions at an adjacent position of upstream side in the tape feed direction parallel with the sub-scanning direction D2 (see FIG. 13) concerning the dot corresponding to the present print period G(N).

G(N+1) indicates a print period of dot positioned at a position represented coordinate DATA(X, Y+1) within the print area Z (see FIG. 13) among dots existing on the next print line. That is to say, the dot corresponding to the next print period G(N+1) positions at an adjacent position of downstream side in the tape feed direction parallel with the sub-scanning direction D2 (see FIG. 13) concerning the dot corresponding to the present print period G(N).

A print period F for one line of print lines is divided into main pulse adding time MH, sub-pulse adding time SH and off-time OFF.

As shown in FIGS. 17 and 18, the print pulse added within the main pulse adding time MH is defines as main pulse MP. The dot on the print line to which the main pulse is added is the "color development dot". That is to say, in FIG. 17, the dot positioned at the coordinate DATA(X, Y) within the print area Z (see FIG. 13), such dot positioning on the print line corresponding to the present print period G(N), is color-developed. On the other hand, in FIG. 18, the dot positioned at the coordinate DATA(X, Y+1) within the print area Z (see FIG. 13), such dot positioning on the print line corresponding to the next print period G(N+1), is color-developed.

As shown in FIG. 17, in case that the main pulse is added in the present print period G(N) and is not added in the next print period G(N+1), the print pulse added within the sub-pulse adding time SH in the present print period G(N) is defined as supplemental pulse HP. That is to say, the supplemental pulse HP is the print pulse only supplementing color development function by the main pulse MP in the present print period G(N) during which the supplemental pulse HP is added and the supplemental pulse HP itself does not have color developing ability.

As shown in FIG. 18, in case that the main pulse is not added in the present print period G(N) and is added in the next print period G(N+1), the print pulse added within the sub-pulse adding time SH in the present print period G(N) is defined as preheat pulse YP. That is to say, the preheat pulse YP is the print pulse only supplementing color development function by the main pulse MP in the next print period G(N+1) during which the main pulse MP is added and the preheat pulse YP itself does not have color developing ability.

The sub-pulse means the print pulse added within the sub-pulse adding time SH, and includes the supplemental pulse HP and the preheat pulse YP. Here, the off time OFF is the time that any of the main pulse MP, the supplemental pulse HP and the preheat pulse YP is not added during the print period F for one line of print lines.

Returning to FIG. 4, a variable number memory 42 stores variable numbers necessary when the CPU 27 executes various programs. Among the variable numbers, there is included a variable number A, a variable number X, a variable number Y, a variable number M, a variable number S, a variable number for "END", a variable number of "divisional number", a variable number of "printing speed", a variable number of "target speed" and a variable number of "present speed".

The work area 43 retains areas necessary when the CPU 27 executes various programs.

The pulse motor 24 rotates the platen roller 22, thereby the print tape 3A is fed by the platen roller 22.

The motor drive circuit 31 drives to rotate the pulse motor 24 and controls rotational speed of the pulse motor 24 by adding motor pulses to the pulse motor 24.

The thermal head control circuit 32 controls turning on and turning off of the heat elements 23A (see FIG. 15) in the thermal head 23 while changing states of turning on and turning off every the line print data for one line unit in the print lines by dividing the print data stored in the print data memory 41 (the main data M_DATA(X, Y), the supplemental data S_DATA(X, Y), the preheat data P_DATA(X, Y) and the sub-data SUB_DATA(X, Y)), after feeding of the print tape 3A is started by the platen roller 22.

Here, in the embodiment, 360 heat elements 23A (see FIG. 15) in the thermal head 23 can be turned on every two heat areas divided into two areas according to the main scanning direction D1 perpendicular to the sub-scanning direction D2 (see FIG. 13) coinciding with the tape feed direction. This print operation is defined as "divisional printing" hereinafter. However, the print operation is not limited to this, but the heat elements 23A may be turned on every more than three heat areas.

Figure 9:
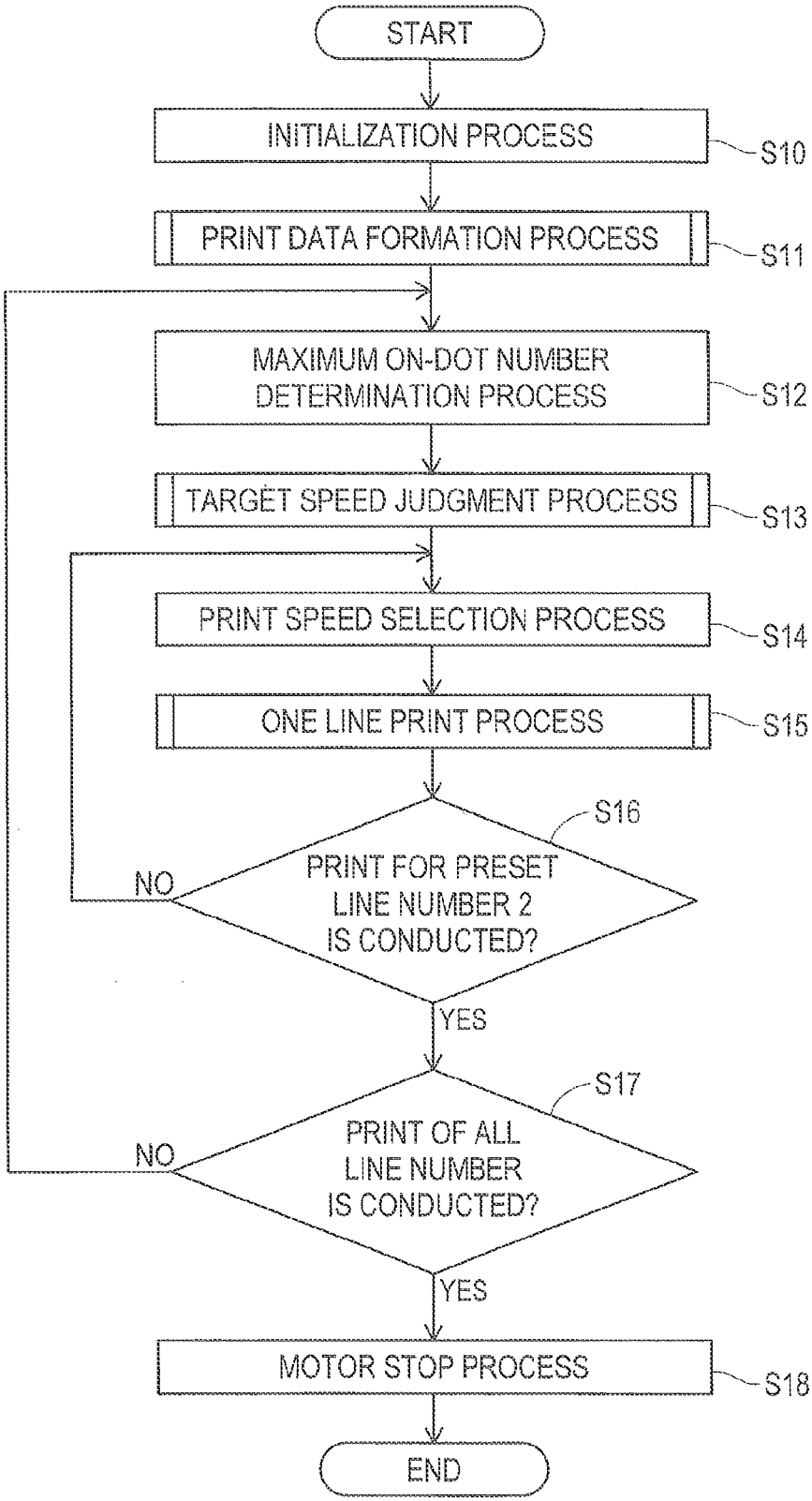
FIG. 9 is a main flowchart indicating control procedure executed by CPU.

The CPU 27 controls the motor drive circuit 31 and the thermal head drive circuit 32 in the print device 1 by using tables such as the preset line number table 33 and programs of flowcharts shown in FIG. 9, based on the image data stored in the print buffer 40 transmitted from the personal computer 26, thereby makes printing on the print tape 3A based on the image data.

[Preset Line Number Table]

The preset line number table 33 shown in FIG. 5 is stored in the ROM 28 (see FIG. 4) as data table. In this data table, number "20" is stored corresponding to "preset line number 1" and number "10" is stored corresponding to "preset line number 2". Here, both the number "20" corresponding to "preset line number 1" and the number "10" corresponding to "preset line number 2" indicate line number of print lines.

[Dot Number Table]

The on-dot number table 35 shown in FIG. 6 is stored in the ROM 28 (see FIG. 4) as data table. In this data table, the number "180" is stored corresponding to "maximum on-dot number" and the number "360" is stored corresponding to "total dot number of head". Here, the number "180" corresponding to "maximum on-dot number" is a threshold value used in flowcharts shown in FIG. 11. The number "360" means the total number of 360 heat elements 23A in the thermal head 23.

[Table for Speed and Printing]

The table 36 for speed and printing shown in FIG. 7 is stored in the ROM 28 (see FIG. 4) as data table. In this data table, items of "speed", "print pulse" and "divisional printing" are allotted to each "number" among numbers "0"~"25".

In the item of "speed", feed speed of the print tape 3A is stored and represented by dimension [mm/s].

In the item of "print pulse", kinds of print pulse added during print period F for one line of print lines (see FIGS. 16 to 18) are stored. For the items "0"~"24" among items of "number", "main pulse+supplemental pulse" are stored in the item of "print pulse". This means that the main pulse MP (see FIGS. 17 and 18) and the supplemental pulse HP (see FIG. 17) exist as the kind of print pulse added during the print period F (see FIGS. 16 to 18) for one line of print lines until the speed to feed the print tape 3A (see FIG. 13) exists within 0~110 [mm/s]. Contrarily, for only the item "25" among items of "number", "main pulse+sub-pulse (supplemental pulse+preheat pulse)" are stored in the item of "print pulse". This means that the main pulse MP (see FIGS. 17 and 18), the supplemental pulse HP (see FIG. 17) and the preheat pulse YP (see FIG. 18) exist as the kind of print pulse added during the print period F (see FIGS. 16 to 18) for one line of print lines when the speed to feed the print tape 3A (see FIG. 13) exceeds 110 [mm/s].

In the item "divisional printing", it is stored whether or not "divisional printing" can be conducted. Concretely, in the item of "divisional printing", among the items "number", "○" indicating that "divisional printing" can be done is stored in "0"~"9". Contrarily, among the items "number", "–" indicating that "divisional printing" cannot be done is stored in "10"~"25". This means that "divisional printing" can be done until the feed speed of the print tape 3A (see FIG. 13) reaches 0~30 [mm/s], "divisional printing" cannot be done after the feed speed of the print tape 3A exceeds 30 [mm/s].

[Acceleration-Deceleration Table]

The acceleration-deceleration table 37 shown in FIG. 8 is stored in the ROM 28 (see FIG. 4) as data table. This data table is a table utilized when through-up control and through-down control of the pulse motor 24 (see FIG. 4) is conducted. In the acceleration-deceleration table 37, "present speed", "target speed" and "print speed" are stored corresponding to the item "number" of "0"~"25" in the table 37 for speed and printing shown in FIG. 7. Here, "present speed", "target speed" and "print speed" respectively indicate the feed speed to feed the print tape 3A (see FIG. 13).

For instance, in the acceleration-deceleration table 37 shown in FIG. 8, "0" indicates that the feed speed to feed the print tape 3A is the lowest speed of 0 [mm/s] (see FIG. 7). "1" indicates that the feed speed to feed the print tape 3A is 2 [mm/s] (see FIG. 7). "2" indicates that the feed speed to feed the print tape 3A is 4 [mm/s] (see FIG. 7). Similarly, "25" indicates that the feed speed to feed the print tape 3A is the highest speed of 114 [mm/s] (see FIG. 7).

Furthermore, it will be described reading method of the acceleration-deceleration table 37 shown in FIG. 8. For example, it will be conceived a through-up control case that "target speed" to feed the print tape 3A (see FIG. 13) is "24" and "present speed" to feed the print tape 3A is "21".

In the through-up control case, at first, "22" existing at the intersectional point of "24" of "target speed" and "21" of "present speed" is set to "print speed" to feed the print tape 3A (see FIG. 13), by using the acceleration-deceleration table 37 shown in FIG. 8.

Next, "22" of "print speed" is set to "present speed" and "23" existing at the intersectional point of "24" of "target speed" and "22" of "present speed" is set to "print speed" to feed the print tape 3A (see FIG. 13) by using the acceleration-deceleration table 37 shown in FIG. 8.

Continuously, "23" of "print speed" is set to "present speed" and "24" existing at the intersectional point of "24" of "target speed" and "23" of "present speed" is set to "print speed" to feed the print tape 3A (see FIG. 13) by using the acceleration-deceleration table 37 shown in FIG. 8.

Next, "24" of "print speed" is set to "present speed" and "24" existing at the intersectional point of "24" of "target speed" and "24" of "present speed" is set to "print speed" to feed the print tape 3A (see FIG. 13) by using the acceleration-deceleration table 37 shown in FIG. 8. Hereinafter, similar reading method is repeated based on the acceleration-deceleration table 37 of FIG. 8 and both of "print speed" and "present speed" are retained as "24".

Here, on the contrary, it will be conceived the through-down control case that "target speed" to feed the print tape 3A (see FIG. 13) is "9" and "present speed" to feed the print tape 3A is "17".

In the above through-down control case, at first, "15" existing at the intersectional point of "9" of "target speed" and "17" of "present speed" is set to "print speed" to feed the print tape 3A (see FIG. 13), by using the acceleration-deceleration table 37 shown in FIG. 8.

Next, "15" of "print speed" is set to "present speed" and "12" existing at the intersectional point of "9" of "target speed" and "15" of "present speed" is set to "print speed" to feed the print tape 3A (see FIG. 13) by using the acceleration-deceleration table 37 shown in FIG. 8.

Continuously, "12" of "print speed" is set to "present speed" and "9" existing at the intersectional point of "9" of "target speed" and "12" of "present speed" is set to "print speed" to feed the print tape 3A (see FIG. 13) by using the acceleration-deceleration table 37 shown in FIG. 8.

Next, "9" of "print speed" is set to "present speed" and "9" existing at the intersectional point of "9" of "target speed" and "9" of "present speed" is set to "print speed" to feed the print tape 3A (see FIG. 13) by using the acceleration-deceleration table 37 shown in FIG. 8. Hereinafter, similar reading method is repeated based on the acceleration-deceleration table 37 of FIG. 8 and both of "print speed" and "present speed" are retained as "9".

[Control Flowcharts]

The CPU 27 executes the program of flowchart shown in FIG. 9. First, at step 10 (hereinafter, abbreviated as "S"), the CPU 27 executes initialization process. In this initialization process, for example, "0" is substituted in the variable number of "print speed".

At S11, the CPU 27 executes print data formation process. In this print data formation process, the CPU 27 executes the program of flowchart shown in FIG. 10 and forms the supplemental data S_DATA(X, Y), the preheat data P_DATA(X, Y) and the sub-data SUB_DATA(X, Y) by using the main data M_DATA(X, Y). Here, the main data M_DATA(X, Y) coincides with the image data which is the two-dimensional data groups transmitted from the personal computer 26.

In FIG. 10, at step S21, the CPU 27 substitutes "0" in a range of X=0~359 and Y=0~END to each of two-dimensional data groups of the supplemental data S_DATA(X, Y), the preheat data P_DATA(X, Y) and the sub-data SUB_DATA(X, Y). That is to say, for the supplemental data S_DATA(X, Y), the preheat data P_DATA(X, Y) and the sub-data SUB_DATA (X, Y), the range of print area Z is made "0". Here, as mentioned, END is the variable number indicating Y-direction position of the last print line in the print area z.

At S22, the CPU 27 substitutes "0" for the variable numbers X and Y. At S23, the CPU 27 determines whether the main data M_DATA(X, Y)=1 is established. Here, if the main data M_DATA(X, Y)=1 is established (S23: YES), procedure shifts to S24.

At S24, the CPU 27 determines whether the variable number Y is smaller than the variable number END. Here, if the variable number Y is not smaller than the variable number END (S24: NO), procedure shifts to S30 mentioned hereinafter. On the contrary, if the variable number Y is smaller than the variable number END (S24: YES), procedure shifts to S25.

At S25, the CPU 27 determines whether the main data M_DATA(X, Y+1)=0. Here, if the main data M_DATA(X, Y+1)=0 is not established (S25: NO), procedure shifts to S30 mentioned hereinafter. Contrarily, if the main data M_DATA (X, Y+1)=0 is established (S25: YES), procedure shifts to S26.

At S26, the CPU 27 sets the supplemental data S_DATA(X, Y)=1. Thereafter, procedure shifts to S30 mentioned hereinafter.

On the other hand, at the above S23, if the main data M_DATA(X, Y)=1 is not established (S23: NO), procedure shifts to S27.

At S27, the CPU 27 determines whether the variable number Y is smaller than the variable number END. Here, if the variable number Y is not smaller than the variable number END (S27: NO), procedure shifts to S30 mentioned hereinafter. On the contrary, if the variable number Y is smaller than the variable number END (S27: YES), procedure shifts to S28.

At S28, the CPU 27 determines whether the main data M_DATA(X, Y+1)=0 is established. Here, if the main data M_DATA(X, Y+1)=0 is established (S28: YES), procedure shifts to S30 mentioned hereinafter. On the contrary, if the main data M_DATA(X, Y+1)=0 is not established (S28: NO), procedure shifts to S29.

At S29, the CPU 27 sets the preheat data P_DATA(X, Y)=1. Thereafter, procedure shifts to S30.

At S30, the CPU 27 determines whether both the supplemental data S_DATA(X, Y)=0 and the preheat data P_DATA (X, Y)=0 are established. Here, if the supplemental data S_DATA(X, Y)=1 or the preheat data P_DATA(X, Y)=1 is established (S30: NO), procedure shifts to S31.

At S31, the CPU 27 sets the sub-data SUB_DATA(X, Y)=1. Thereafter, procedure shifts to S32 mentioned hereinafter.

On the other hand, at the above S30, if the supplemental data S_DATA(X, Y)=0 and the preheat data P_DATA(X, Y)=0 are established (S30: YES), procedure shifts to S32.

At S32, the CPU 27 adds "1" to the variable number X. Thereafter, procedure shifts to S33.

At S33, the CPU 27 determines whether the variable number X is "360". Here, if the variable number X is not "360" (S33: NO), procedure returns to S23 and processes after S23 are repeated. On the contrary, if the variable number X is "360" (S33: YES), procedure shifts to S34.

At S34, the CPU 27 substitutes "0" to the variable number X and "1" to the variable number Y. Thereafter, procedure shifts to S35.

At S35, the CPU 27 determines whether the number obtained by adding "1" to the variable number END and the variable number Y is equal with each other. Here, if the number obtained by adding "1" to the variable number END is not equal with the variable number Y (S35: NO), procedure returns to S23 and processes after S23 are repeated. On the contrary, if the number obtained by adding "1" to the variable number END is equal with the variable number Y (S35: YES), procedure returns to S12 in FIG. 9 after the print data formation process indicated in FIG. 10 is done.

As mentioned above, by executing the print data formation process in FIG. 10, the supplemental data S_DATA(X, Y), the preheat data P_DATA(X, Y) and the sub-data SUB_DATA(X, Y) are formed.

Hereinafter, it will be described with reference to FIG. 14 the supplemental data S_DATA(X, Y), the preheat data P_DATA(X, Y) and the sub-data SUB_DATA(X, Y), formed according to the above.

Figure 14:
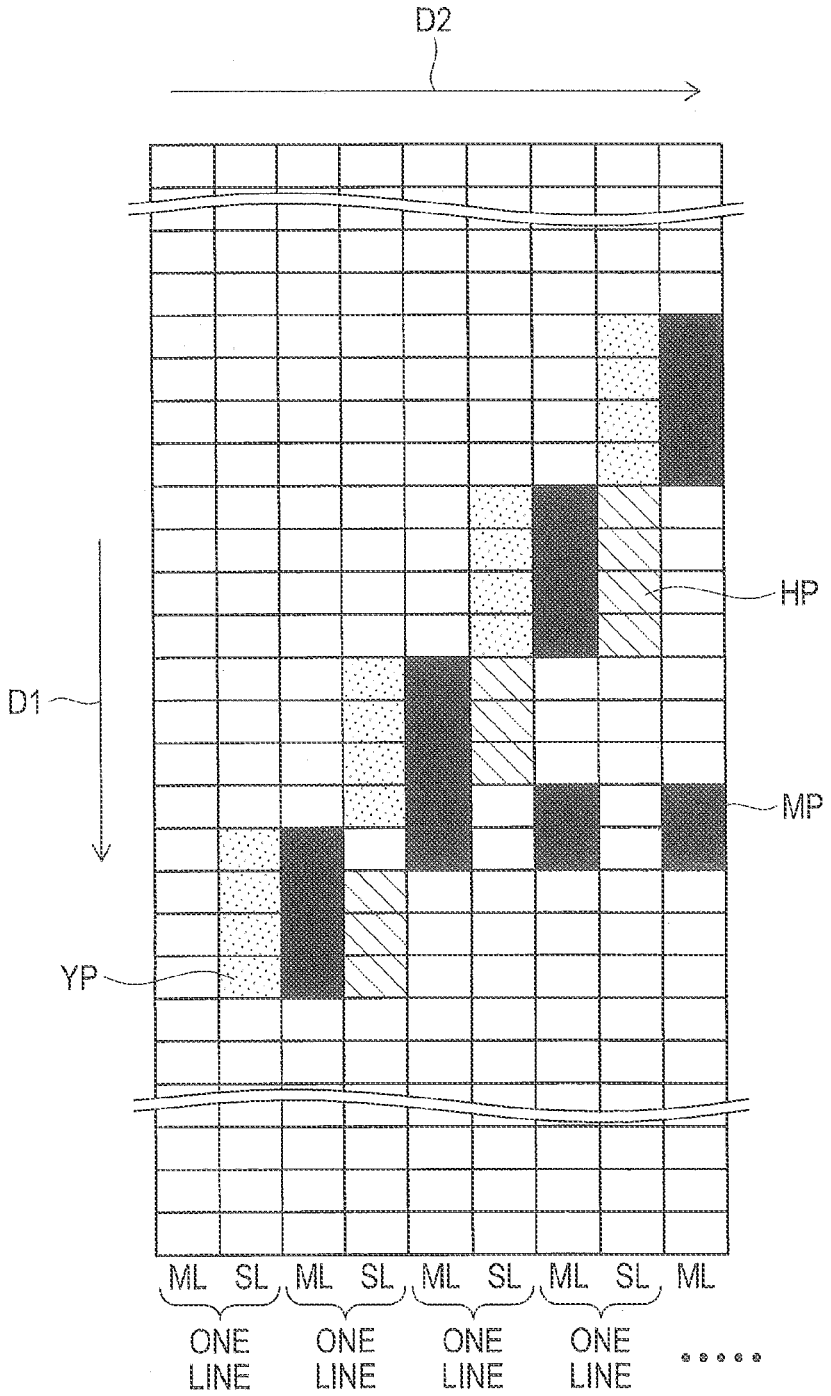
FIG. 14 is a an explanatory view indicating additional state of a main pulse, a supplement-pulse and a preheat-pulse in each line among plural lines each of which lines up in sub-scanning direction and parallel with main-scanning direction.

In FIG. 14, each one line of plural print lines arranged in the direction parallel with the main scanning direction D1 and along with the sub-scanning direction D2 is structured from the main line ML to which the main pulse MP (see FIGS. 17 and 18) is added and the sub-line SL to which one of the supplemental pulse HP (see FIG. 17) and the preheat pulse YP (see FIG. 18) is added.

The main line ML and the sub-line SL forming each one line of print lines is sectioned totally in 360 sections, 360 representing the total number of heat elements 23A (see FIG. 15) on the thermal head 23. In each one line of print lines, one section of the main line ML and one section of the sub-line SL, the main line ML and the sub-line SL being arranged with an adjacent relation in the sub-scanning direction D2, forms one dot.

At the right side (downstream side in the tape feed direction) of the sub-scanning direction D2, one print line adjacent to the present print one line is the next one print line. Contrarily, at the left side of the sub-scanning direction, one print line adjacent to the present print one line is the previous print one line.

Hereafter, it will be described the supplemental data S_DATA(X, Y) formed on the basis of the main data M_DATA(X, Y) by executing the print data formation process shown in FIG. 10.

Here, when the main pulse MP (see FIGS. 17 and 18) is added to one dot of the present print one line (S23: YES) and is not added to one dot of the next print one line adjacent to the right side (downstream side in the tape feed direction) of the one dot in the sub-scanning direction D2 (S25: YES), it is supposed that the supplemental pulse HP (see FIG. 17) is added to the one dot of the present print one line. That is to say, "1" is substituted to the supplemental data S_DATA(X, Y) corresponding to the one dot of present print one line (S26).

On the contrary, when the main pulse MP (see FIGS. 17 and 18) is added to one dot of the present print one line (S23: YES) and one dot of the next print one line adjacent to the right side (downstream side in the tape feed direction) of the one dot in the sub-scanning direction D2 (S25: YES) does not exist (S24: NO), it is supposed that the supplemental pulse HP (see FIG. 17) is not added to the one dot of the present print one line. That is to say, it is continued a state that "0" is substituted to the supplemental data S_DATA(X, Y) corresponding to the one dot of present print one line (S21).

Further, when the main pulse MP (see FIGS. 17 and 18) is added to one dot of the present print one line (S23: YES) and is also added to one dot of the next print one line adjacent to the right side (downstream side in the tape feed direction) of the one dot in the sub-scanning direction D2 (S25: NO), it is supposed that the supplemental pulse HP (see FIG. 17) is not added to the one dot of the present print one line. That is to say, it is continued a state that "0" is substituted to the supplemental data S_DATA(X, Y) corresponding to the one dot of present print one line (S21).

Furthermore, when the main pulse MP (see FIGS. 17 and 18) is not added to one dot of the present print one line (S23: NO) and is not added to one dot of the next print one line adjacent to the right side (downstream side in the tape feed direction) of the one dot in the sub-scanning direction D2 (S28: YES), it is supposed that the supplemental pulse HP (see FIG. 17) is not added to the one dot of the present print one line. That is to say, it is continued a state that "0" is substituted to the supplemental data S_DATA(X, Y) corresponding to the one dot of present print one line (S21).

Hereafter, it will be described the preheat data P_DATA(X, Y) formed on the basis of the main data M_DATA(X, Y) by executing the print data formation process shown in FIG. 10.

Here, when the main pulse MP (see FIGS. 17 and 18) is not added to one dot of the present print one line (S23: NO) and is added to one dot of the next print one line adjacent to the right side (downstream side in the tape feed direction) of the one dot in the sub-scanning direction D2 (S28: NO), it is supposed that the preheat pulse YP (see FIG. 18) is added to the one dot of the present print one line. That is to say, "1" is substituted to the preheat data P_DATA(X, Y) corresponding to the one dot of present print one line (S29).

Further, when the main pulse MP (see FIGS. 17 and 18) is added to one dot of the present print one line (S23: YES) and is also added to one dot of the next print one line adjacent to the right side (downstream side in the tape feed direction) of the one dot in the sub-scanning direction D2 (S25: NO), it is supposed that the preheat pulse YP (see FIG. 18) is not added to the one dot of the present print one line. That is to say, it is continued a state that "0" is substituted to the preheat data P_DATA(X, Y) corresponding to the one dot of present print one line (S21).

Furthermore, when the main pulse MP (see FIGS. 17 and 18) is not added to one dot of the present print one line (S23: NO) and one dot of the next print one line adjacent to the right side (downstream side in the tape feed direction) of the one dot in the sub-scanning direction D2 does not exist (S27: NO), it is supposed that the preheat pulse YP (see FIG. 18) is not added to the one dot of the present print one line. That is to say, it is continued a state that "0" is substituted to the preheat data P_DATA(X, Y) corresponding to the one dot of present print one line (S21).

Furthermore, when the main pulse MP (see FIGS. 17 and 18) is not added to one dot of the present print one line (S23: NO) and is not added to one dot of the next print one line adjacent to the right side (downstream side in the tape feed direction) of the one dot in the sub-scanning direction D2 (S28: YES), it is supposed that the preheat pulse YP (see FIG. 18) is not added to the one dot of the present print one line. That is to say, it is continued a state that "0" is substituted to the preheat data P_DATA(X, Y) corresponding to the one dot of present print one line (S21).

Hereafter, it will be described the sub-data SUB_DATA(X, Y) formed by executing the print data formation process shown in FIG. 10.

The sub-data SUB_DATA(X, Y) is the logical sum of the supplemental data S_DATA(X, Y) and the preheat data P_DATA(X, Y) (S21, S30, S31). That is to say, the sub-data SUB_DATA(X, Y)=1 means that one of the supplemental pulse HP (see FIG. 17) and the preheat pulse YP (see FIG. 18) is added to one dot of one print line corresponding to the sub-data SUB_DATA(X, Y). On the contrary, the sub-data SUB_DATA(X, Y)=0 means that any of the supplemental pulse HP (see FIG. 17) and the preheat pulse YP (see FIG. 18) is not added to one dot of one print line corresponding to the sub-data SUB_DATA(X, Y).

As mentioned above, after the print data formation process in FIG. 10 is done, procedure returns to FIG. 9 and the CPU 27 executes the maximum on-dot number determination process at S12. In the maximum on-dot number determination process, the CPU 27 refers the dot number table 35 shown in FIG. 6 and the number "180" corresponding to the "maximum on-dot number" is substituted to the variable number A. Here, the number "180" means a half number of total 360 heat elements 23A on the thermal head 23.

At S13, the CPU 27 executes the target speed judgment process. This target speed judgment process is done by executing the program of flowchart shown in FIG. 11 through the CPU 27.

Figure 11:
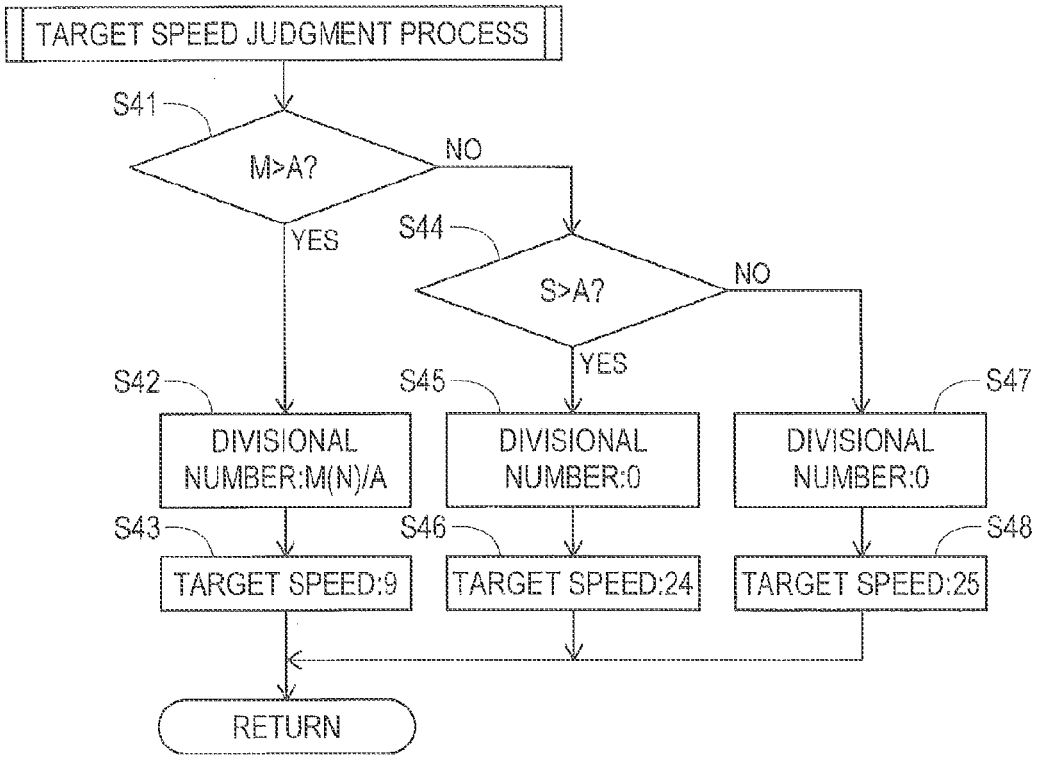
FIG. 11 is a sub-flowchart indicating control procedure executed by CPU.

In FIG. 11, at S41, the CPU 27 determines whether the variable number M is larger than the variable number A. Here, the variable number M is obtained as follows. That is to say, every 20 print lines lined up to the number "20" corresponding to the "preset line number 1" at the right side (downstream side in tape feed direction) from the present print line in the sub-scanning direction D2, it is counted a dot number that the main pulse MP (see FIGS. 17 and 18) is added. Further, the most count number is substituted to the variable number M. Here, this counting is done based on the main data M_DATA (X, Y). And the number "20" corresponding to the "preset line number 1" is read out from the preset line number table 33 shown in FIG. 5. The variable number A is "180" as mentioned above.

Here, when the variable number M is larger than the variable number A (S41: YES), procedure shifts to S42. At S42, the CPU 27 sets a value of variable number M/variable number A to the variable number of "divisional number". Here, although the value of variable number M/variable number A is calculated by bringing forward decimal, such value becomes "2" in the embodiment. At S43, the CPU 27 sets "9" to the variable number of "target speed". Thereafter, procedure shifts to S13 in FIG. 9.

On the contrary, at S41, when the variable number M is not larger than the variable number A (S41: NO), procedure shifts to S44. At S44, the CPU 27 determines whether the variable number S is larger than the variable number A. Here, the variable number S is obtained as follows. That is to say, every 20 print lines lined up to the number "20" corresponding to the "preset line number 1" at the right side (downstream side in tape feed direction) from the present print line in the sub-scanning direction D2, it is counted a dot number that the supplemental pulse HP (see FIG. 17) is added. Further, the most count number is substituted to the variable number S. Here, this counting is done based on the supplemental data S_DATA(X, Y). And the number "20" corresponding to the "preset line number 1" is read out from the preset line number table 33 shown in FIG. 5. The variable number A is "180" as mentioned above.

Here, when the variable number S is larger than the variable number A (S44: YES), procedure shifts to S45. At S45, the CPU 27 sets "0" to the variable number of "divisional number". At S46, the CPU 27 sets "24" to the variable number of "target speed". Thereafter, procedure shifts to S13 in FIG. 9.

On the contrary, when the variable number S is not larger than the variable number A (S44: NO), procedure shifts to S47. At S47, the CPU 27 sets "0" to the variable number of "divisional number". At S48, the CPU 27 sets "25" to the variable number of "target speed". Thereafter, procedure shifts to S13.

As described above, after the target speed judgment process shown in FIG. 11 is done, procedure returns to FIG. 9. The CPU 27 executes the print speed selection process at S14. In the print speed selection process, the variable number of "print speed" is obtained by using the acceleration-deceleration table 37 shown in FIG. 8. Thereafter, procedure shifts to S15.

For example, in case that "9" is set to the variable number of "target speed" and "1" is set to the variable number of "present speed", "9" existing at the intersectional point of "9" of "target speed" and "1" of "present speed" is obtained as the variable number of "print speed" by using the acceleration-deceleration table 37 shown in FIG. 8.

On the contrary, when "9" is set to the variable number of "target speed" and "15" is set to the variable number of "present speed", "12" existing at the intersectional point of "9" of "target speed" and "15" of "present speed" is obtained as the variable number of "print speed" by using the acceleration-deceleration table 37 shown in FIG. 8.

When "24" is set to the variable number of "target speed" and "1" is set to the variable number of "present speed", "10" existing at the intersectional point of "24" of "target speed" and "1" of "present speed" is obtained as the variable number of "print speed" by using the acceleration-deceleration table 37 shown in FIG. 8.

On the contrary, when "24" is set to the variable number of "target speed" and "25" is set to the variable number of "present speed", "24" existing at the intersectional point of "24" of "target speed" and "25" of "present speed" is obtained as the variable number of "print speed" by using the acceleration-deceleration table 37 shown in FIG. 8.

Further, when "25" is set to the variable number of "target speed" and "1" is set to the variable number of "present speed", "10" existing at the intersectional point "25" of "target speed" and "1" of "present speed" is obtained as the variable number of "print speed" by using the acceleration-deceleration table 37 shown in FIG. 8.

On the contrary, when "25" is set to the variable number of "target speed" and "25" is set to the variable number of "present speed", "25" existing at the intersectional point of "25" of "target speed" and "25" of "present speed" is obtained as the variable number of "print speed" by using the acceleration-deceleration table 37 shown in FIG. 8.

Returning to FIG. 9, at S15, the CPU 27 executes one line print process. This one line print process is done by executing the program of flowchart shown in FIG. 12 through the CPU 27.

Figure 12:
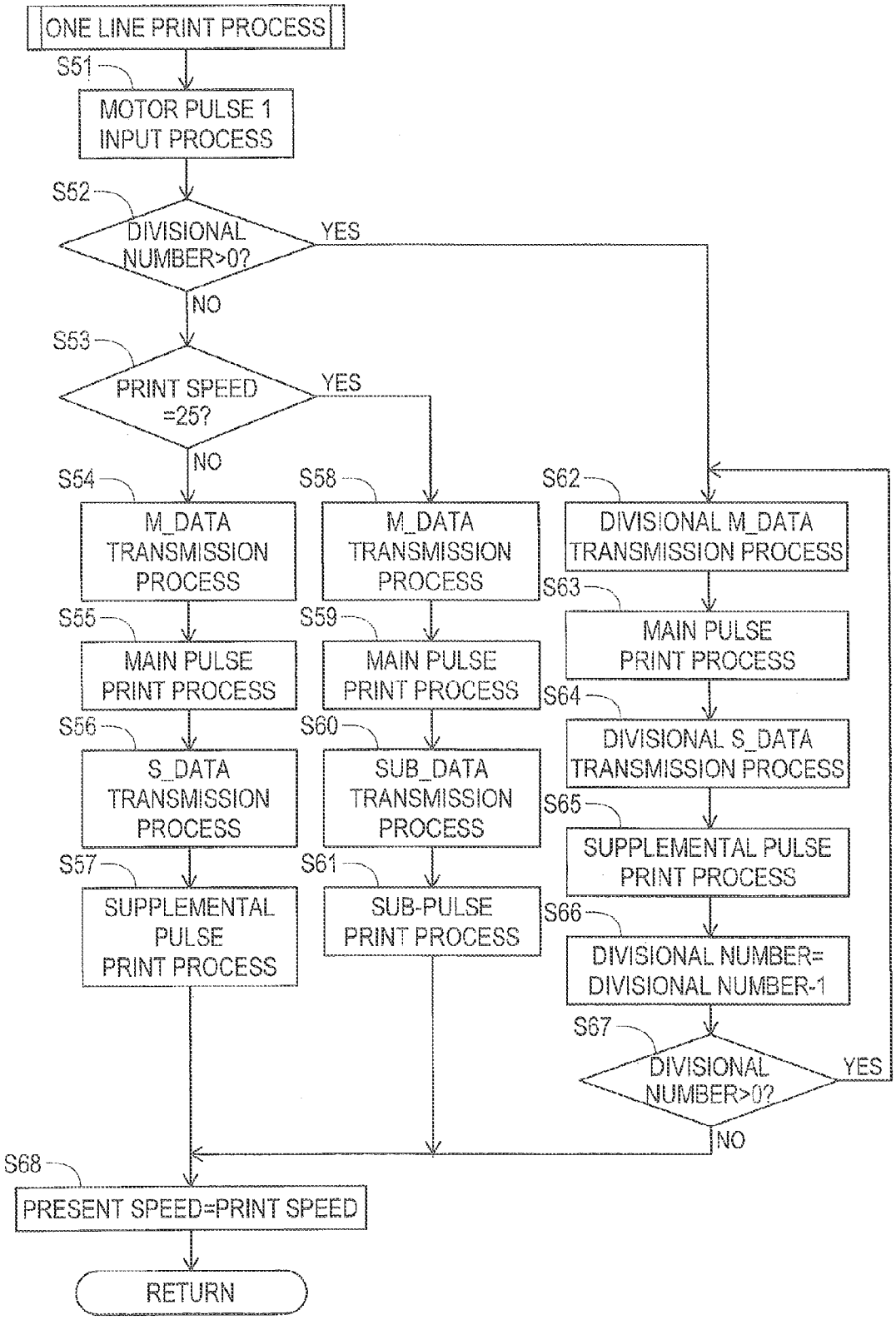
FIG. 12 is a sub-flowchart indicating control procedure executed by CPU.

In FIG. 12, at S51, the CPU 27 executes the motor pulse 1 input process. In the motor pulse 1 input process, the CPU 27 inputs motor pulse 1 to the pulse motor 24 so that the feed speed feeding the print tape 3A (see FIG. 13) becomes a speed corresponding to the "number" which is the variable number of "print speed" (see FIGS. 19 and 20 described hereinafter).

At S52, the CPU 27 determines whether the variable number of "divisional number" is larger than "0". If the variable number of "divisional number" is not larger than "0" (S52: NO), procedure shifts to S53. At S53, the CPU 27 determines whether the variable number of "print speed" is "25". If the variable number of "print speed" is not "25" (S53: NO), procedure shifts to S54.

At S54, the CPU 27 executes transmission process of the main data M_DATA(X, Y). Concretely, the main data M_DATA(X, Y) for one line of the present print lines is transmitted to the thermal head control circuit 32.

At S55, the CPU 27 executes main pulse print process. Concretely, the thermal head control circuit 32 adds the main pulse MP (see FIGS. 17 and 18) to the heat elements 23A of thermal head 23 based on the main data M_DATA(X, Y) for one line of the present print lines. Thereafter, the CPU 27 inputs motor pulse 2 to the pulse motor 24 so that the feed speed feeding the print tape 3A (see FIG. 13) becomes a speed corresponding to the "number" which is the variable number of "print speed" (see FIG. 19 described hereinafter).

At S56, the CPU 27 executes supplemental data transmission process. Concretely, the supplemental data S_DATA(X, Y) for one line of the present print lines is transmitted to the thermal head control circuit 32.

At S57, the CPU 27 executes supplemental pulse print process. Concretely, the thermal head control circuit 32 adds the supplemental pulse HP (see FIG. 17) to the heat elements 23A of thermal head 23 based on the supplemental data S_DATA(X, Y) for one line of the present print lines. That is, in this process, the preheat pulse YP (see FIG. 18) is not added to the heat elements 23A. Thereafter, procedure shifts to S68 described hereinafter.

On the other hand, at the above S53, if the variable number of "print speed" is "25" (S53: YES), procedure shifts to S58.

At S58, the CPU 27 executes transmission process of the main data M_DATA(X, Y). Concretely, the main data M_DATA(X, Y) for one line of the present print lines is transmitted to the thermal head control circuit 32.

At S59, the CPU 27 executes main pulse print process. Concretely, the thermal control circuit 32 adds the main pulse MP (see FIGS. 17 and 18) to the head elements 23A of thermal head 23 based on the main data M_DATA(X, Y) for one line of the present print lines. Thereafter, the CPU 27 inputs motor pulse 2 to the pulse motor 24 so that the feed speed feeding the print tape 3A (see FIG. 13) becomes a speed corresponding to the "number" which is the variable number of "print speed" (see FIG. 19 described hereinafter).

At S60, the CPU 27 executes transmission process of the sub-data SUB_DATA(X, Y). Concretely, the sub-data SUB_

DATA(X, Y) for one line of the present print lines is transmitted to the thermal head control circuit 32.

At S61, the CPU 27 executes sub-pulse print process. Concretely, the thermal head control circuit 32 adds the supplemental pulse HP (see FIG. 17) or the preheat pulse YP (see FIG. 18) to the heat elements 23A of thermal head 23 based on the sub-data SUB_DATA(X, Y) for one line of the present print lines. That is, in this process, the supplemental pulse HP (see FIG. 17) or the preheat pulse YP (see FIG. 18) is added. Thereafter, procedure shifts to S68.

On the other hand, if the variable number of "divisional number" is larger than "0" (S52: YES), procedure shifts to S62. At S62, the CPU 27 executes transmission process of the divisional main data M_DATA(X, Y). Concretely, the main data M_DATA(X, Y) corresponding to the main data M_DATA(X, Y) obtained by dividing the main data M_DATA (X, Y) for one line of the present print lines by the variable number of "divisional number", is added to the thermal head control circuit 32.

At S63, the CPU 27 executes main pulse print process. Concretely, the thermal head control circuit 32 adds the main pulse MP (see FIGS. 17 and 18) to the head elements 23A of thermal head 23 based on the main data M_DATA(X, Y) obtained by dividing the main data M_DATA(X, Y) for one line of the present print lines by the variable number of "divisional number".

At S64, the CPU 27 executes transmission process of divisional supplemental data S_DATA(X, Y). Concretely, the supplemental data S_DATA(X, Y) corresponding to the supplemental data S_DATA(X, Y) obtained by dividing the supplemental data S_DATA(X, Y) for one line of the present print lines by the variable number of "divisional number", is transmitted to the thermal head control circuit 32.

At S65, the CPU 27 executes supplemental pulse print process. Concretely, the thermal head control circuit 32 adds the supplemental pulse HP (see FIG. 17) to the heat elements 23A of thermal head 23 based on the supplemental data S_DATA(X, Y) obtained by dividing the supplemental data S_DATA(X, Y) for one line of the present print lines by the variable number of "divisional number". That is, in this process, the preheat pulse YP (see FIG. 18) is not added.

At S66, the CPU 27 subtracts "1" from the variable number of "divisional number". At S67, the CPU 27 determines whether the variable number of "divisional number" is larger than "0". If the variable number of "divisional number" is larger than "0" (S67: YES), procedure returns to S62 and processes after S62 are repeated. Here, before and after process of S62 is repeated, the CPU 27 inputs motor pulse 2 to the pulse motor 24 so that the feed speed feeding the print tape 3A (see FIG. 13) becomes a speed corresponding to the "number" which is the variable number of "print speed" (see FIG. 20 hereinafter described).

On the contrary, if the variable number of "divisional number" is not larger than "0" (S67: NO), the CPU 27 returns the variable number of "divisional number" to "0" or "2" set in the target speed judgment process in S13. Thereafter, procedure shifts to S68.

At S68, the CPU 27 substitutes the "number" corresponding to the variable number of "print speed" to the variable number of "present speed". Thereafter, procedure shifts to S16 in FIG. 9.

Hereinafter, so that the feed speed feeding the print tape 3A (see FIG. 13) becomes the speed corresponding to the "number" which is the variable number of "print speed", timing to input motor pulse 1 and motor pulse 2 to the pulse motor 24 and timing of data transmission will be described with reference to FIGS. 19 and 20.

Figure 19:
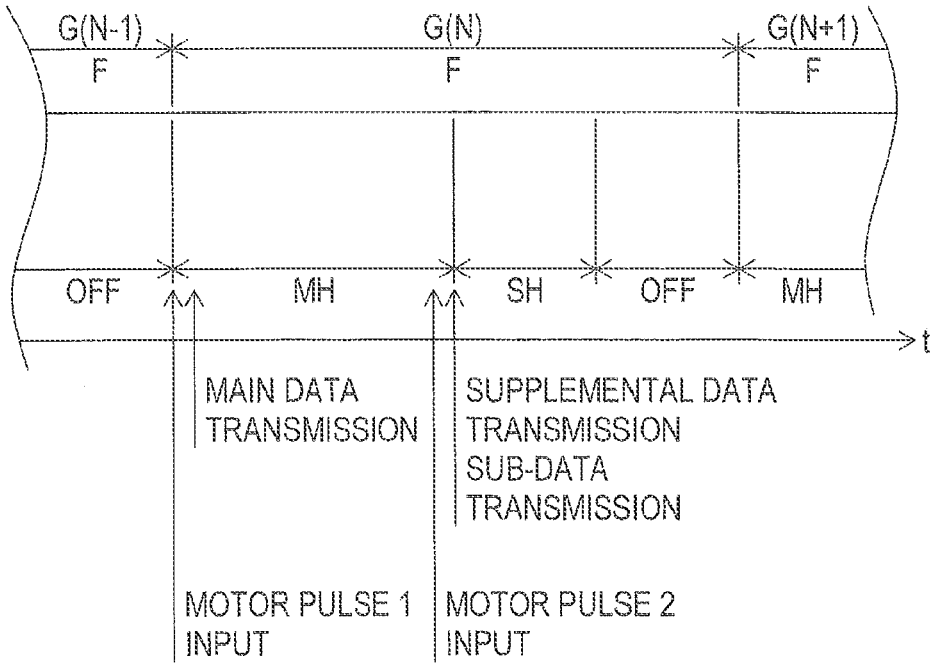
FIG. 19 is an explanatory view indicating a timing according to which a motor pulse is input and data are transmitted.

In case that one line printing is done according to S51 to S57 in FIG. 12, motor pulse input and data transmission are conducted at the timing shown in FIG. 19. That is to say, when the main pulse adding time MH in the present print period G(N) is started, the motor pulse 1 is input to the pulse motor 24 (S51) and the main data M_DATA(X, Y) is continuously transmitted (S54). And right before the sub-pulse adding time SH in the present print period G(N) is started, the motor pulse 2 is input to the pulse motor 24. Further, when the sub-pulse adding time SH in the present print period G(N) is started, the supplemental data S_DATA(X, Y) is transmitted (S56).

In case that one line printing is conducted according to S51~S53, S58~S61, motor pulse input or data transmission is done at the timing indicated in FIG. 19. That is to say, when the main pulse adding time MH in the present print period G(N) is started, the motor pulse 1 is input to the pulse motor 24 (S51), and the main data M_DATA(X, Y) is continuously transmitted (S58). And right before the sub-pulse adding time SH in the present print period G(N) is started, the motor pulse 2 is input to the pulse motor 24, and when the sub-pulse adding time SH in the present print period G(N) is started, the sub-data SUB_DATA(X, Y) is transmitted (S60).

Figure 20:
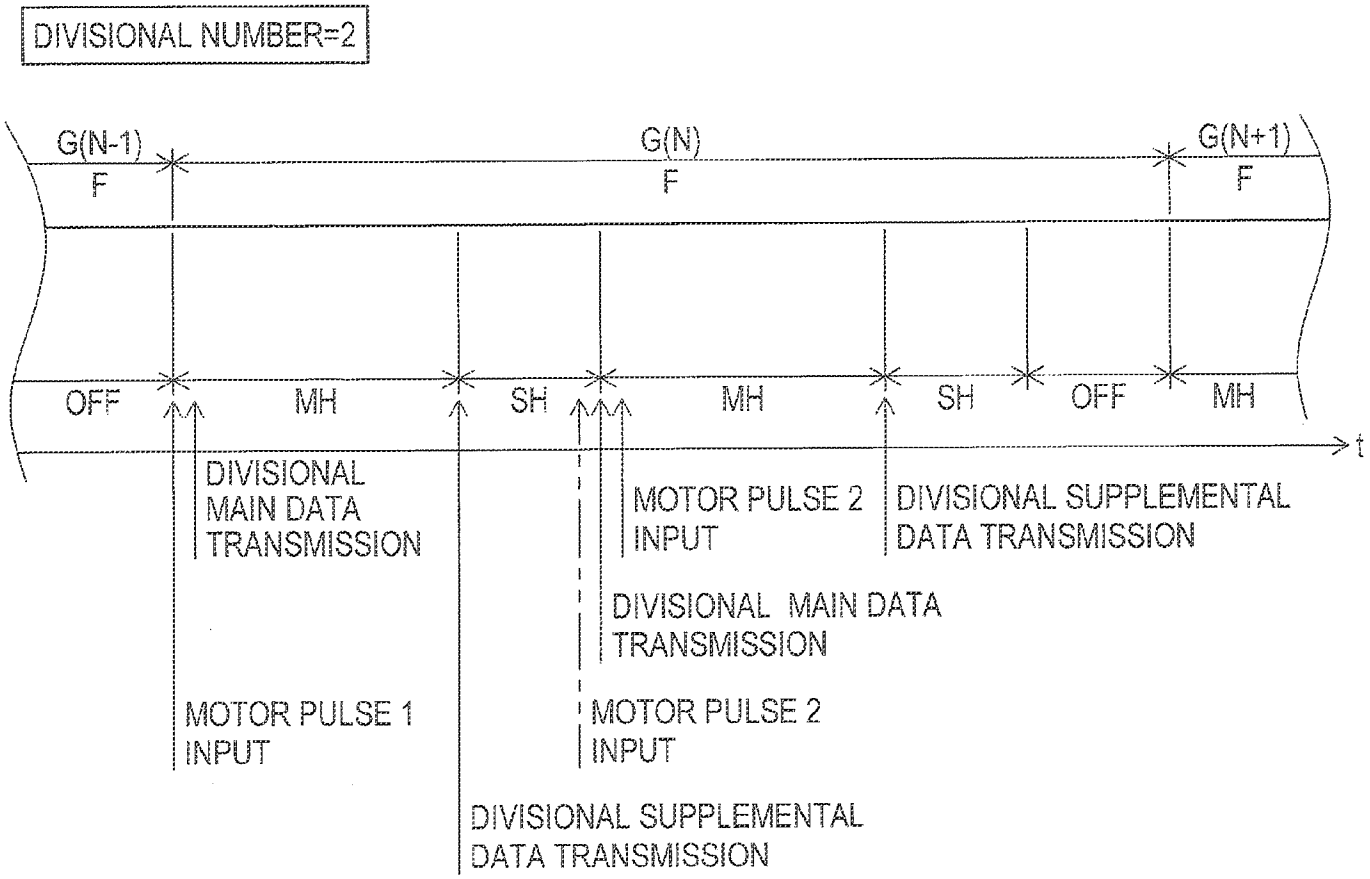
FIG. 20 is an explanatory view indicating a timing according to which a motor pulse is input and data are transmitted.

In case that one line printing is conducted according to S51, S52, S62~S67, this case corresponds to a case that "divisional printing" where the variable number of "divisional number" is 2 is conducted in the embodiment, and motor pulse input process or data transmission is done at the timing shown in FIG. 20. That is to say, when the first main pulse adding time MH in the present print period G(N) is started, the motor pulse 1 is input to the pulse motor 24 (S51) and the first divisional main data M_DATA(X, Y) is continuously transmitted (S62). When the first sub-pulse adding time SH in the present print period G(N) is started, the first divisional supplemental data S_DATA(X, Y) is transmitted (S64). Further, right before or after the last main pulse adding time MH in the present print period G(N) is started, the motor pulse 2 is input to the pulse motor 24. When the last main pulse adding time MH in the present print period G(N) is started, the last divisional main data M_DATA(X, Y) is transmitted (S62). Thereafter, when the last sub-pulse adding time SH in the present print period G(N) is started, the last divisional supplemental data S_DATA(X, Y) is transmitted (S64).

Returning to FIG. 9, at S16, the CPU 27 determines whether one line printing up to the number "10" corresponding to "preset line number 2" is conduced. Here, the number "10" corresponding to "preset line number 2" is read out from the preset line number table 33 shown in FIG. 5. When it is determined that one line printing up to the number "10" corresponding to "preset line number 2" is not conducted (S16: NO), procedure returns to S14 and processes of S14 to S16 are repeated.

At that time, when the variable number of "target speed" is set to the number "9" (S43 in FIG. 11), divisional printing by the main pulse MP (see FIGS. 17 and 18) and the supplemental pulse HP (see FIG. 17) is done (S51, S52, S62~S67 in FIG. 12) by using the acceleration-deceleration table 37 shown in FIG. 8 and the table 36 indicating relation between speed and printing shown in FIG. 7. During divisional printing, the pulse motor 24 is controlled so that the feed speed feeding the print tape 3A (see FIG. 13) becomes 30 [mm/s] corresponding to the number "9" which is the variable number of "target speed".

Further, when the variable number of "target speed" is set to "24" (S46 in FIG. 11), printing by the main pulse MP (see FIGS. 17 and 18) and the supplemental pulse HP (see FIG. 17) is conducted (S51~S57 in FIG. 12) by using the acceleration-deceleration table 37 shown in FIG. 8 and the table 36 indicating relation between speed and printing shown in FIG. 7, because the variable number of "print speed" is the number lower than "25" (S53: NO in FIG. 12). During such printing, the pulse motor 24 is controlled so that the feed speed feeding the print tape 3A (see FIG. 13) becomes 110 [mm/s] corresponding to the number "24" which is the variable number of "target speed".

Furthermore, when the variable number of "target speed" is set to "25" (S48 in FIG. 11), printing by the main pulse MP (see FIGS. 17 and 18), the supplemental pulse HP (see FIG. 17) and the preheat pulse YP (see FIG. 18) is conducted (S51~S53, S58~S61 in FIG. 12) by using the acceleration-deceleration table 37 shown in FIG. 8 and the table 36 indicating relation between speed and printing shown in FIG. 7, because the variable number of "print speed" is the number "25" (S53: YES in FIG. 12). During such printing, the pulse motor 24 is controlled so that the feed speed feeding the print tape 3A (See FIG. 13) becomes 114 [mm/s] corresponding to the number "25" which is the variable number of "target speed".

On the other hand, at S16, when one line printing up to "10" corresponding to "preset line number 2" is conducted (S16: YES), procedure shifts to S17. At S17, the CPU 27 determines whether one line printing is conducted for all print lines. If the one line printing is not conducted for all print lines (S17: NO), procedure returns to S12 and processes of S12 to S17 are repeated. Contrarily, if one line printing for all print lines is conducted (S17: YES), procedure shifts to S18.

At S18, the CPU 27 executes motor stop process. In the motor stop process, the pulse motor 24 is stopped. Thereafter, program shown in FIG. 9 is done.

SUMMARY (1) In the printing device 1 according to the embodiment, every 20 print lines lined up to the number "20" corresponding to the "preset line number 1" at the right side (downstream side in tape feed direction) from the present print line in the sub-scanning direction D2, it is counted a dot number that the main pulse MP (see FIGS. 17 and 18) is added. Further, when the variable number M which is the most count number is larger than the variable number A (S41: YES), the value obtained from variable number M/variable number A is set to the variable number of "divisional number" (S42) and "9" is set to the variable number of "target speed" (S43). One line printing by "divisional printing" in S51, S52, S62~S67 in FIG. 12 (corresponding to "divisional process") is done up to the number "10" corresponding to "preset line number 2". At that time, the main pulse MP (see FIGS. 17 and 18) is added to the heat elements 23A of thermal head 23 (S63) and the supplemental pulse HP (see FIG. 17) is added to the heat elements 23A of thermal head 23 (S65).

(2) Further, when the variable number M which is the most count number is not larger than the variable number A (S41: NO), every 20 print lines lined up to the number "20" corresponding to the "preset line number 1" at the right side (downstream side in tape feed direction) from the present print line in the sub-scanning direction D2, it is counted a dot number that the supplemental pulse HP (see FIG. 17) is added. Further, when the variable number S which is the most count number is larger than the variable number A (S44: YES), the value "0" is set to the variable number of "divisional number" (S45) and "24" is set to the variable number of "target speed" (S46). One line printing in S51~S57 in FIG. 12 (corresponding to "batch process") is done up to the number "10" corresponding to "preset line number 2". At that time, the main pulse MP (see FIGS. 17 and 18) is added to the heat elements 23A of thermal head 23 (S55) and the supplemental pulse HP (see FIG. 17) is added to the heat elements 23A of thermal head 23 (S57).

(3) Furthermore, when the variable number S which is the most count number is not larger than the variable number A (S44: NO), the value "0" is set the variable number of "divisional number" (S47) and "25" is set to the variable number of "target speed" (S48). When "print speed" is not "25" (S53: NO), one line printing in S54~S57 in FIG. 12 is conducted up to "10" corresponding to "preset line number 2". At that time, the main pulse MP (see FIGS. 17 and 18) is added to the heat elements 23A of thermal head 23 (S55) and the supplemental pulse HP (see FIG. 17) is added to the heat elements 23A of thermal head 23 (S57). On the contrary, "print speed" is "25" (S53: YES), one line printing in S58~S61 in FIG. 12 (corresponding to "batch process") is conducted up to "10" corresponding to "preset line number 2". At that time, the main pulse MP (see FIGS. 17 and 18) is added to the heat elements 23A of thermal head 23 (S59) and the supplemental pulse HP (see FIG. 17) or the preheat pulse YP (see FIG. 18) is added to the heat elements 23A of thermal head 23 (S61).

In the case above mentioned (1), one line printing of "divisional printing", which is conducted by adding the main pulse MP (see FIGS. 17 and 18) and the supplemental pulse HP (see FIG. 17), occurs in a state that "target speed" to feed print tape 3A (see FIG. 13) is set to "9" corresponding comparatively low speed.

In the case above mentioned (2), one line printing of "divisional printing", which is conducted by adding the main pulse MP (see FIGS. 17 and 18) and the supplemental pulse HP (see FIG. 17), occurs in a state that "target speed" to feed print tape 3A (see FIG. 13) is set to "24" corresponding comparatively high speed.

In the case above mentioned (3), similar to the case (2), one line printing of "divisional printing", which is conducted by adding the main pulse MP (see FIGS. 17 and 18) and the supplemental pulse HP (see FIG. 17), occurs in s state that "target speed" to feed print tape 3A (see FIG. 13) is set to "24" corresponding comparatively high speed. In addition, one line printing of "divisional printing", which is conducted by adding the main pulse MP (see FIGS. 17 and 18), the supplemental pulse HP (see FIG. 17) and the preheat pulse YP (see FIG. 18), occurs in s state that "target speed" to feed print tape 3A (see FIG. 13) is set to "25" of the highest speed exceeding "24" corresponding comparatively high speed.

[Others]

As described above, the printing device 1 according to the embodiment, "divisional printing" occurs and printing with high speed can be conducted even if the supplemental pulse HP (see FIG. 17) and the preheat pulse YP (see FIG. 18) are utilized in printing.

Here, the present disclosure is not limited to the above embodiment and various changes can be done within the scope of the disclosure.

For example, instead of controlling done according to FIGS. 7, 8, 11 and 12, controlling according to new FIGS. 21, 22, 23 and 24 can be done. Hereafter, differences occurring by changing figures will be described.

In the table for speed and printing of FIG. 7, "main pulse+supplemental pulse" is stored for the "number" item of "18" to "24" in the item of "print pulse". On the other hand, in the table for speed and printing of FIG. 21, "main pulse+sub-pulse (supplemental pulse+preheat pulse)" is stored for the "number" item of "18" to "24" in the item of "print pulse".

In the acceleration-deceleration table shown in FIG. 8, "16" is respectively stored at the intersectional point of "17"~"25" of "target speed" and "14" of "present speed", "18" is respectively stored at the intersectional point of "19"~"25" of "target speed" and "17" of "present speed", "19" is respectively stored at the intersectional point of "20"~"25" of "target speed" and "18" of "present speed", "20" is respectively stored at the intersectional point of "21"~"25" of "target speed" and "19" of "present speed" and "21" is respectively stored at the intersectional point of "22"~"25" of "target speed and "20" of "present speed".

On the other hand, in the acceleration-deceleration table shown in FIG. 22, "17" is respectively stored at the intersectional point of "17"~"25" of "target speed" and "14" of "present speed", "19" is respectively stored at the intersectional point of "19"~"25" of "target speed" and "17" of "present speed", "20" is respectively stored at the intersectional point of "20"~"25" and "18" of "present speed", "21" is respectively stored at the intersectional point of "21"~"25" of "target speed" and "19" of "present speed" and "22" is respectively stored at the intersectional point of "22"~"25" of "target speed" and "20" of "present speed".

That is, in comparison with the acceleration-deceleration table in FIG. 8, at the intersectional point of "17"~"25" of "target speed" and "14" of "present speed", at the intersectional point of "19"~"25" of "target speed" and "17" of "present speed", at the intersectional point of "20"~"25" of "target speed" and "18" of "present speed", at the intersectional point of "21"~"25" of "target speed" and "19" of "present speed" and at the intersectional point of "22"~"25" of "target speed" and "20" of "present speed", the value increased by "1" is stored in the acceleration-deceleration table in FIG. 22.

Thereby, in comparison with a case that the acceleration-deceleration table in FIG. 8 is used for control of the pulse motor 24, when the acceleration-deceleration table in FIG. 22 is used for control of the pulse motor 24, acceleration-deceleration time in the through-up control and through-down control of the pulse motor 24 can be reduced.

Figure 23:
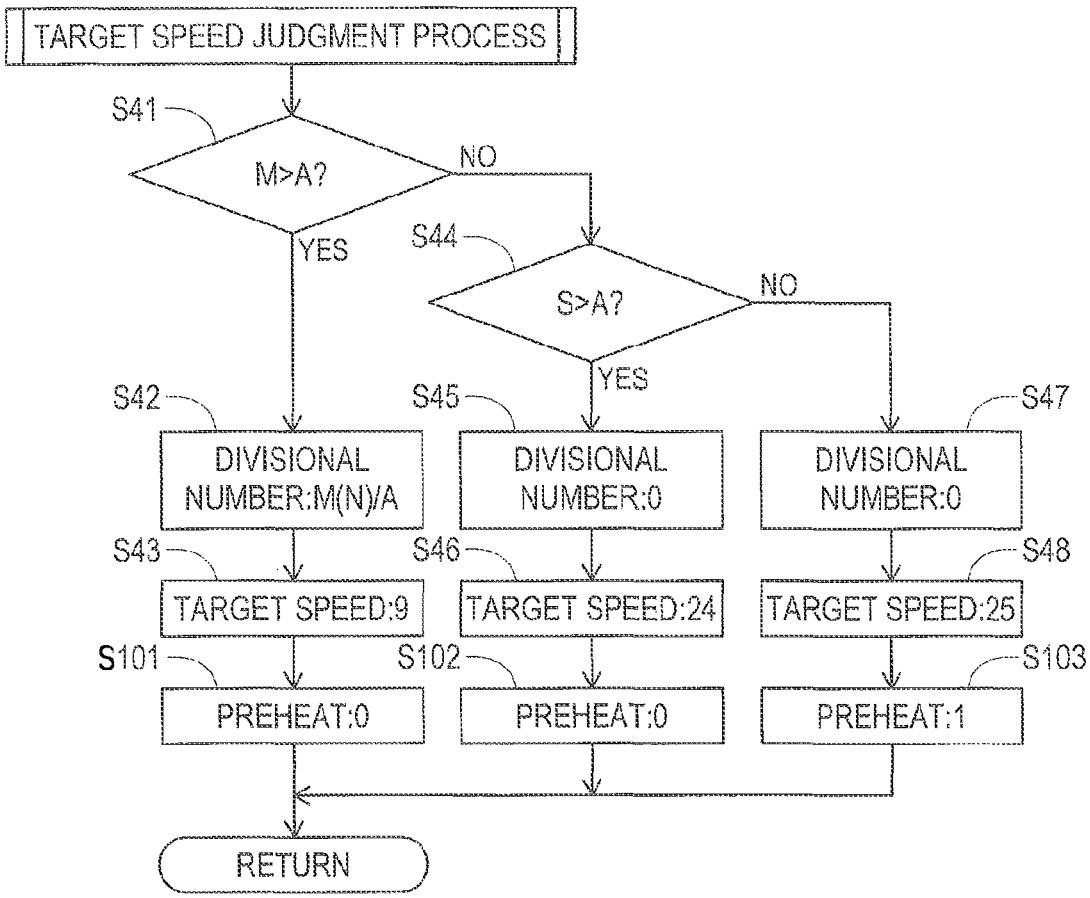
FIG. 23 is a sub-flowchart indicating control procedure executed by CPU.

In the target speed judgment process shown in FIG. 23, comparing with the target speed judgment process shown in FIG. 11, process of S101 in which "0" is substituted to the variable number of "preheat" after S43 is executed, process S102 in which "0" is substituted to the variable number of "preheat" after S46 is executed and process 103 in which "1" is substituted to the variable number of "preheat" after S48 is executed, are added.

In one line print process shown in FIG. 12, it is determined whether the variable number of "present speed" is "25" in determination process of S53. On the contrary, in one line print process shown in FIG. 24, determination process of S104 is executed instead of determination process in S53. In determination process of S104, it is determined whether the variable number of "preheat" is "1".

Figure 24:
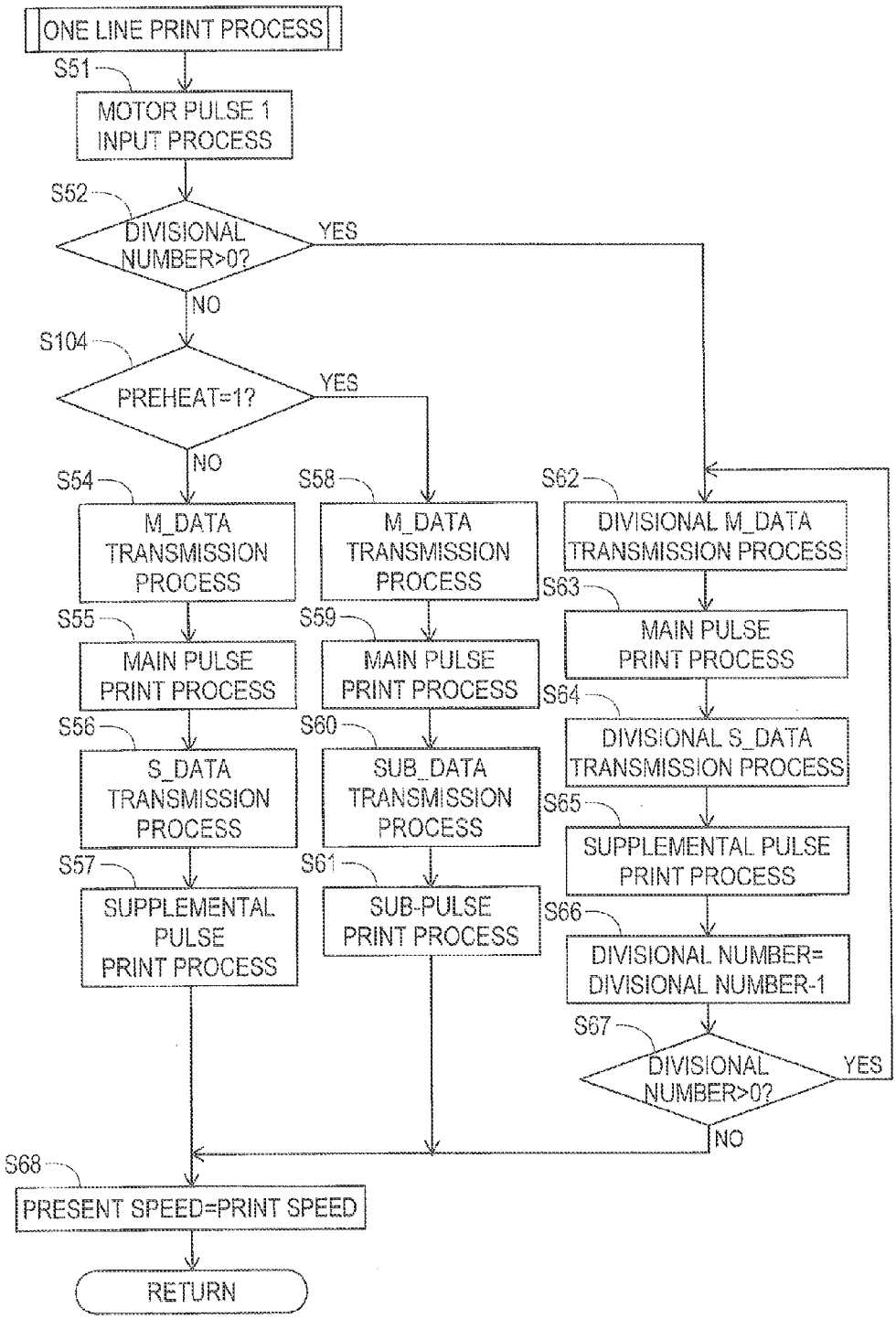
FIG. 24 is a sub-flowchart indicating control procedure executed by CPU.

That is to say, in case that FIGS. 21, 22, 23 and 24 are used instead of FIGS. 7, 8, 11 and 12, when the variable number of "preheat" is "1" (S104: YES) and the variable number of "print speed" is "18"~"25", one line printing by S58~S61 of FIG. 24 is conducted up to "10" corresponding to "preset line number 2". At that time, the main pulse MP (see FIGS. 17 and 18) is added to the heat elements 23A of thermal head 23 (S59) and the supplemental pulse HP (see FIG. 17) or preheat pulse YP (see FIG. 18) is added to the heat elements 23A of thermal head 23 (S61).

Namely before the variable number of "print speed" becomes "25" corresponding to the highest speed exceeding "24" corresponding to comparatively high speed, one line printing by addition of the main pulse MP (see FIGS. 17 and 18), the supplemental pulse HP (see FIG. 17) and the preheat pulse (see FIG. 18) is done up to the number of "10" corresponding "preset line number 2".

While presently exemplary embodiment have been shown and described, it is to be understood that this disclosure is for the purpose of illustration and that various changes and modifications may be made without departing from the scope of the disclosure as set forth in the appended claims.

What is claimed is:

1. A printing device comprising:

a thermal head provided with a line head in which a plurality of heat elements are linearly lined up;

a feeding device for feeding a thermal print medium in a sub-scanning direction normal to the line head of the thermal head; and a control device for controlling the feeding device and the thermal head, wherein the control device conducts a batch process or divisional process of pulse addition to selectively heat the heat elements in the line head of the thermal head in a main scanning direction parallel with the line head every print period continuously and repeatedly, wherein print dots are thereby printed on the thermal print medium fed in the sub-scanning direction by the feeding device in accordance with a feed speed corresponding to the batch process or a feed speed corresponding to the divisional process, wherein a main pulse adding time of applying a main pulse to color-develop the thermal print medium and a sub-pulse adding time of applying a sub-pulse to supplement the main pulse are retained in each of the print periods, wherein the sub-pulse is a supplemental pulse for color-developing the thermal print medium by supplementing the main pulse added in a present print period, the supplemental pulse not being able to independently color-develop the thermal print medium or, a preheat pulse to color-develop the thermal print medium by supplementing the main pulse added in a next print period, the preheat pulse not being able to independently color-develop the thermal print medium, wherein the control device counts a total number of the main pulse every print period within a first predetermined range, and when a maximum value of the total number of the main pulse exceeds a first threshold value, the divisional process is conducted by adding the main pulse and the supplemental pulse every print period within a second predetermined range smaller than the first predetermined range in accordance with the feed speed corresponding to the divisional process, wherein, when the maximum value of the total number of the main pulse does not exceed the first threshold value, the control device counts a total number of the supplemental pulse every print period within the first predetermined range, and, when a maximum value of the total value of the supplemental pulse exceeds a second threshold value, the batch process is conducted by adding the main pulse and the supplemental pulse every print period within the second predetermined range in accordance with the feed speed corresponding to the batch process, and wherein, when the total value of the supplemental pulse does not exceed the second threshold value, the batch process is conducted by adding the main pulse and the supplemental pulse every print period within the second predetermined range at the feed speed corresponding to the batch process and the batch process is conducted by adding the main pulse, the supplemental pulse and the preheat pulse every print period within the second predetermined range until the feed speed shifts to a maximum speed by exceeding the feed speed corresponding to the batch process.

2. The printing device according to claim 1, further comprising:

a pulse motor to drive the feeding device, wherein the control device controls the feeding device so as to shift to and retain the feed speed corresponding to the divisional process, the feed speed corresponding to the batch process or the maximum speed by conducting a through-up control or a through-down control of the pulse motor.

3. The printing device according to claim 2, wherein the control device conducts the batch process every print period within the second predetermined range by adding the main pulse, the supplemental pulse and the preheat pulse before the feed speed exceeds the feed speed corresponding to the batch process and shifts to the maximum speed.

4. The printing device according to claim 3, further comprising:

memory storing:

a first acceleration-deceleration table utilized when the batch process is done every print period within the second predetermined range by adding the main pulse, the supplemental pulse and the preheat pulse before the feed speed exceeds the feed speed corresponding to the batch process and shifts to the maximum speed; and a second acceleration-deceleration table utilized when the batch process is done every print period within the second predetermined range by adding the main pulse, the supplemental pulse and the preheat pulse while the feed speed exceeds the feed speed corresponding the batch process and shifts to the maximum speed, wherein the control device selectively uses the first acceleration-deceleration table and the second acceleration-deceleration table, to thereby reduce a number of times of accelerating the feed speed in the through-up control or the through-down control of the pulse motor by using the first acceleration-deceleration table in comparison with a case that the second acceleration-deceleration table is used.

* * * * *